US009965917B2

(12) United States Patent
Tsuchiya et al.

(10) Patent No.: US 9,965,917 B2
(45) Date of Patent: May 8, 2018

(54) GAMING MACHINE FOR CHANGING GAME SOUND IN FREE GAME AND CONTROL METHOD THEREOF

(75) Inventors: Naoki Tsuchiya, Koto-ku (JP); Kohei Hashimoto, Koto-ku (JP); Hiroki Abe, Koto-ku (JP); Takanori Sakata, Koto-ku (JP)

(73) Assignee: ARUZE GAMING AMERICA, INC., Las Vegas, NV (US)

( * ) Notice: Subject to any disclaimer, the term of this patent is extended or adjusted under 35 U.S.C. 154(b) by 1255 days.

(21) Appl. No.: 12/566,378

(22) Filed: Sep. 24, 2009

(65) Prior Publication Data

US 2010/0093425 A1 Apr. 15, 2010

Related U.S. Application Data

(60) Provisional application No. 61/104,408, filed on Oct. 10, 2008.

(51) Int. Cl.
*G07F 17/32* (2006.01)

(52) U.S. Cl.
CPC ..... *G07F 17/32* (2013.01); *G07F 17/3227* (2013.01); *G07F 17/3267* (2013.01)

(58) Field of Classification Search
CPC .. G07F 17/32; G07F 17/3267; G07F 17/3227; A63F 13/54
USPC ..... 463/35
See application file for complete search history.

(56) References Cited

U.S. PATENT DOCUMENTS

| | | | | |
|---|---|---|---|---|
| 4,283,709 | A | 8/1981 | Lucero et al. | |
| 4,624,459 | A | 11/1986 | Kaufman | |
| 4,669,731 | A | 6/1987 | Clarke | |
| 4,837,728 | A | 6/1989 | Barrie et al. | |
| 4,964,638 | A | 10/1990 | Ishida | |
| 5,280,909 | A | 1/1994 | Tracy | |
| 5,564,700 | A | 10/1996 | Celona | |
| 5,611,730 | A | 3/1997 | Weiss | |
| 5,639,088 | A | 6/1997 | Schneider et al. | |
| 5,695,402 | A | 12/1997 | Stupak | |
| 5,702,303 | A | 12/1997 | Takemoto et al. | |
| 5,743,798 | A * | 4/1998 | Adams | A63F 5/00 273/142 B |
| 5,770,533 | A | 6/1998 | Franchi | |
| 5,820,459 | A | 10/1998 | Acres et al. | |
| 5,836,817 | A | 11/1998 | Acres et al. | |
| 5,890,963 | A | 4/1999 | Yen | |
| 5,910,048 | A | 6/1999 | Feinberg | |
| 6,001,016 | A | 12/1999 | Walker et al. | |
| 6,003,013 | A | 12/1999 | Boushy et al. | |
| 6,089,980 | A | 7/2000 | Gauselmann | |

(Continued)

FOREIGN PATENT DOCUMENTS

| | | |
|---|---|---|
| DE | 32 42 890 A1 | 5/1984 |
| DE | 37 12 841 A1 | 11/1988 |

(Continued)

*Primary Examiner* — Werner Garner
(74) *Attorney, Agent, or Firm* — EIP US LLP

(57) ABSTRACT

A slot machine displays on a display a unit game in which arranged symbols are rearranged. When a predetermined condition is satisfied, the slot machine displays on the display a free game that is a special game. The slot machine also changes a game sound that has been emitted into a different game sound when a predetermined condition is satisfied in the free game.

18 Claims, 15 Drawing Sheets

(56) References Cited

U.S. PATENT DOCUMENTS

| | | | | |
|---|---|---|---|---|
| 6,224,482 | B1 | 5/2001 | Bennett | |
| 6,234,896 | B1 | 5/2001 | Walker et al. | |
| 6,244,957 | B1 | 6/2001 | Walker et al. | |
| 6,254,483 | B1 | 7/2001 | Acres | |
| 6,257,981 | B1 | 7/2001 | Acres et al. | |
| 6,270,409 | B1 | 8/2001 | Shuster | |
| 6,273,820 | B1 | 8/2001 | Haste, III | |
| 6,695,697 | B1 | 2/2004 | Okada | |
| 6,848,996 | B2 * | 2/2005 | Hecht et al. | 463/35 |
| 6,932,704 | B2 | 8/2005 | Walker et al. | |
| 6,932,707 | B2 | 8/2005 | Duhamel | |
| 2003/0069073 | A1 | 4/2003 | Okada | |
| 2003/0073491 | A1 * | 4/2003 | Hecht et al. | 463/35 |
| 2004/0053695 | A1 * | 3/2004 | Mattice | G07F 17/3262 463/42 |
| 2005/0026676 | A1 * | 2/2005 | Olive | 463/20 |
| 2005/0245309 | A1 * | 11/2005 | Englman | 463/20 |
| 2008/0030455 | A1 * | 2/2008 | Foxenland | A63F 13/10 345/156 |
| 2010/0248806 | A1 * | 9/2010 | Englman et al. | 463/20 |

FOREIGN PATENT DOCUMENTS

| | | | |
|---|---|---|---|
| DE | 41 37 010 | A1 | 8/1992 |
| DE | 100 49 444 | A1 | 11/2001 |
| EP | 0 631 798 | A1 | 1/1995 |
| EP | 0 840 264 | A1 | 5/1998 |
| EP | 1 192 975 | A1 | 4/2002 |
| EP | 1 302 914 | A2 | 4/2003 |
| EP | 1 351 180 | A2 | 10/2003 |
| EP | 1 477 947 | A2 | 11/2004 |
| EP | 1 544 811 | A2 | 6/2005 |
| GB | 2 326 830 | A | 1/1999 |
| WO | WO 03/083795 | A1 | 10/2003 |
| WO | WO 2004/095383 | A1 | 11/2004 |

* cited by examiner

| | COLUMN1 | COLUMN2 | COLUMN3 | COLUMN4 | COLUMN5 |
|---|---|---|---|---|---|
| ROW1 | q11 | q21 | q31 | q41 | q51 |
| ROW2 | q12 | q22 | q32 | q42 | q52 |
| ROW3 | q13 | q23 | q33 | q43 | q53 |
| ROW4 | q14 | q24 | q34 | q44 | q54 |

GAMING MACHINE FOR CHANGING GAME SOUND IN FREE GAME AND CONTROL METHOD THEREOF

CROSS REFERENCE TO RELATED APPLICATION

This application claims priority to U.S. provisional patent application Ser. No. 61/104,408 filed on Oct. 10, 2008, and which is incorporated by reference herein for all purposes.

BACKGROUND OF THE INVENTION

1. Field of the Invention

The present invention relates to a slot machine for playing a game using medals and the like, and a control method thereof.

2. Description of the Related Art

As described in U.S. Pat. No. 5,820,459 specification, U.S. Pat. No. 6,695,697 specification, U.S. Patent Application Publication No. 2003/0,069,073 specification, European Patent Application Publication No. 1,192,975 specification, U.S. Pat. No. 6,254,483 specification, U.S. Pat. No. 5,611,730 specification, U.S. Pat. No. 5,639,088 specification, U.S. Pat. No. 6,257,981 specification, U.S. Pat. No. 6,234,896 specification, U.S. Pat. No. 6,001,016 specification, U.S. Pat. No. 6,273,820 specification, U.S. Pat. No. 6,224,482 specification, U.S. Pat. No. 4,669,731 specification, U.S. Pat. No. 6,244,957 specification, U.S. Pat. No. 5,910,048 specification, U.S. Pat. No. 5,695,402 specification, U.S. Pat. No. 6,003,013 specification, U.S. Pat. No. 4,283,709 specification, European Patent Application Publication No. 0,631,798 specification, German Patent Application Publication No. 4,137,010 specification, British Patent Application Publication No. 2,326,830 specification, German Patent Application Publication No. 3,712,841 specification, U.S. Pat. No. 4,964,638 specification, U.S. Pat. No. 6,089,980 specification, U.S. Pat. No. 5,280,909 specification, U.S. Pat. No. 5,702,303 specification, U.S. Pat. No. 6,270,409 specification, U.S. Pat. No. 5,770,533 specification, U.S. Pat. No. 5,836,817 specification, U.S. Pat. No. 6,932,704 specification, U.S. Pat. No. 6,932,707 specification, U.S. Pat. No. 4,837,728 specification, European Patent Application Publication No. 1,302,914 specification, U.S. Pat. No. 4,624,459 specification, U.S. Pat. No. 5,564,700 specification, PCT Patent Application Publication No. 03/083,795 specification, German Patent Application Publication No. 3,242,890 specification, European Patent Application Publication No. 0,840,264 specification, German Patent Application Publication No. 10,049,444 specification, PCT Patent Application Publication No. 04/095,383 specification, European Patent Application Publication No. 1,544,811 specification, U.S. Pat. No. 5,890,963 specification, European Patent Application Publication No. 1,477,947 specification, and European Patent Application Publication No. 1,351,180 specification, in a facility having slot machines installed therein, a player can play a game provided by a slot machine by placing a wager such as coins or credits.

For example, every time the player makes a bet in a slot machine and presses a start switch, the slot machine executes a slot game in which a plurality of symbols arranged on a display are rearranged. Thereafter, when the symbols thus rearranged on the display include a predetermined number of scatter symbols or when a predetermined winning combination is formed on a payline, the slot machine provides an award corresponding to the contents of the scatter symbols or the winning combination.

Furthermore, in the slot machine, a special game is executed when a predetermined condition is satisfied. In many cases, the special game is a free game that the player can play without placing a wager, and is also called a feature game. In the special game represented by the free game, there is a chance to get more awards.

However, since the special game is the free game, the player can only watch the game without doing anything. Thus, expectations of the player are reduced.

SUMMARY OF THE INVENTION

A first aspect of the present invention is a slot machine comprising: a display configured to display a unit game rearranging a plurality of arranged symbols in partitioned regions, and to display a predetermined number of free games upon satisfaction of a predetermined condition; a speaker configured to emit a game sound to an outside of the slot machine; a storage device configured to store sound data on the game sound to be emitted in the free games; a speaker drive circuit configured to transmit the sound data to the speaker; and a controller configured to (a) determine whether a rearrangement pattern of symbols rearranged in the predetermined number of the free games satisfies the predetermined condition, and (b) when determining that the rearrangement pattern satisfies the predetermined condition, read out the sound data stored in the storage device and transmit the read out sound data to the speaker drive circuit to change the game sound being currently emitted into a game sound corresponding to the read out sound data.

A second aspect of the present invention is a slot machine comprising: a display configured to display a unit game rearranging a plurality of arranged symbols in partitioned regions, and to display a predetermined number of free games upon satisfaction of a predetermined condition; a speaker configured to emit a game sound to an outside of the slot machine; a storage device configured to store sound data on the game sound to be emitted in the free games; a speaker drive circuit configured to transmit the sound data to the speaker; and a controller configured to (a) determine whether a rearrangement pattern of symbols rearranged in the predetermined number of the free games satisfies the predetermined condition, and (b) when determining that the rearrangement pattern satisfies the predetermined condition, read out the sound data stored in the storage device and transmit the read out sound data to the speaker drive circuit to change the game sound being currently emitted into a game sound corresponding to the read out sound data, and (c) when determining that the rearrangement pattern satisfies the predetermined condition, increase a current number of remaining free games.

A third aspect of the present invention is a slot machine comprising: a display configured to display a unit game rearranging a plurality of arranged symbols in partitioned regions, and to display a predetermined number of free games upon satisfaction of a predetermined condition; a speaker configured to emit a game sound to an outside of the slot machine; a storage device configured to store sound data on the game sound to be emitted in the free games; a speaker drive circuit configured to transmit the sound data to the speaker; and a controller configured to (a) determine whether a rearrangement pattern of symbols rearranged in the predetermined number of the free games satisfies the predetermined condition, and (b) every time when determining that the rearrangement pattern satisfies the predetermined condition, read out the sound data stored in the storage device and transmit the read out sound data to the speaker drive circuit to change the game sound being currently emitted into a game sound corresponding to the read out sound data, and (c) every time when determining that the rearrangement pattern satisfies the predetermined condition, increase a current number of remaining free games.

A fourth aspect of the present invention is a method for controlling a slot machine including a display configured to display a unit game rearranging a plurality of arranged symbols in partitioned regions and to display a predetermined number of free games upon satisfaction of a predetermined condition, a speaker configured to emit a game sound to an outside of the slot machine, a storage device configured to store sound data on the game sound to be emitted in the free games, and a speaker drive circuit configured to transmit the sound data to the speaker, the method comprising: determining whether a rearrangement pattern of symbols rearranged in the predetermined number of the free games satisfies the predetermined condition; and when determining that the rearrangement pattern satisfies the predetermined condition, reading out the sound data stored in the storage device and transmitting the read out sound data to the speaker drive circuit to change the game sound being currently emitted into a game sound corresponding to the read out sound data.

A fifth aspect of the present invention is a method for controlling a slot machine including a display configured to display a unit game rearranging a plurality of arranged symbols in partitioned regions and to display a predetermined number of free games upon satisfaction of a predetermined condition, a speaker configured to emit a game sound to an outside of the slot machine, a storage device configured to store sound data on the game sound to be emitted in the free games, and a speaker drive circuit configured to transmit the sound data to the speaker, the method comprising: determining whether a rearrangement pattern of symbols rearranged in the predetermined number of the free games satisfies the predetermined condition; when determining that the rearrangement pattern satisfies the predetermined condition, reading out the sound data stored in the storage device and transmitting the read out sound data to the speaker drive circuit to change the game sound being currently emitted into a game sound corresponding to the read sound data; and when determining that the rearrangement pattern satisfies the predetermined condition, increasing a current number of remaining free games.

A sixth aspect of the present invention is a method for controlling a slot machine including a display configured to display a unit game rearranging a plurality of arranged symbols in partitioned regions and to display a predetermined number of free games upon satisfaction of a predetermined condition, a speaker configured to emit a game sound to an outside of the slot machine, a storage device configured to store sound data on the game sound to be emitted in the free games, and a speaker drive circuit configured to transmit the sound data to the speaker, the method comprising: determining whether a rearrangement pattern of symbols rearranged in the predetermined number of the free games satisfies the predetermined condition; every time when determining that the rearrangement pattern satisfies the predetermined condition, reading out the sound data stored in the storage device and transmitting the read out sound data to the speaker drive circuit to change the game sound being currently emitted into a game sound corresponding to the read out sound data; and every time when determining that the rearrangement pattern satisfies the predetermined condition, increasing a current number of remaining free games.

DETAILED DESCRIPTION OF THE EMBODIMENTS

First Embodiment

Figure 1A:
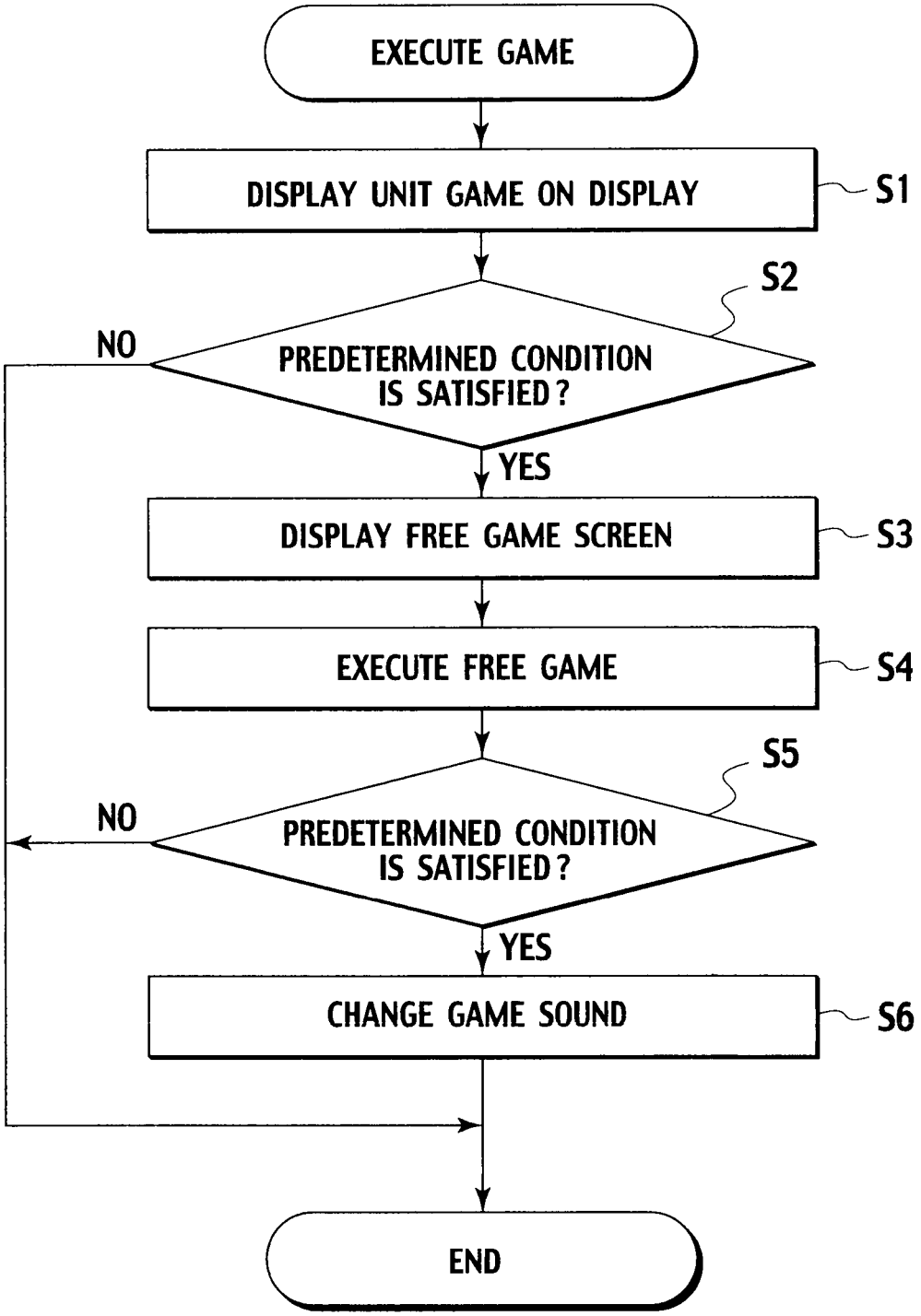
FIG. 1A is a flowchart schematically showing a slot machine and a control method thereof according to a first embodiment, which is an example of a slot machine of the present invention.
Figures 2, 3:
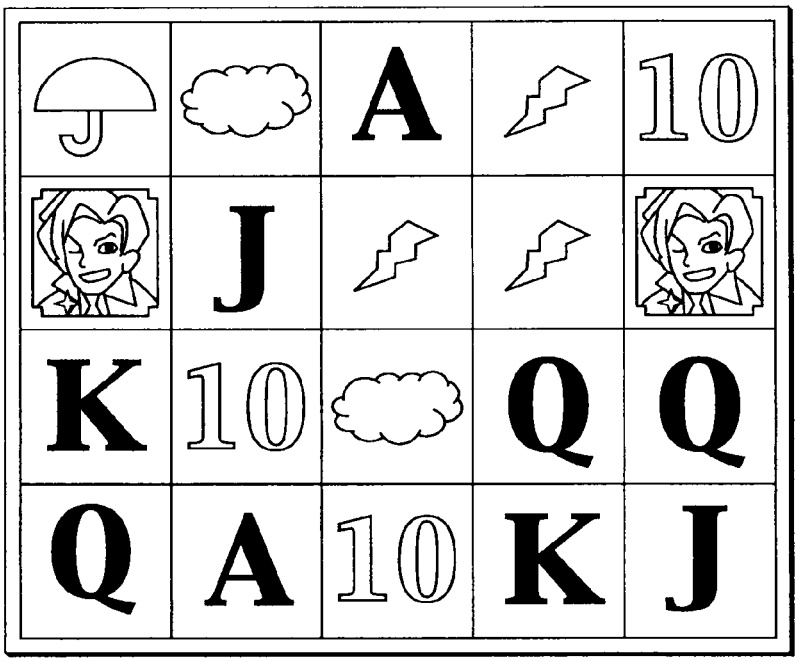
FIG. 2 is an explanatory view showing a display example displayed on a display in the slot machine according to the first embodiment of the present invention.
FIG. 3 is an explanatory view showing partitioned regions in a matrix pattern provided on the display in the slot machine according to the first embodiment of the present invention.
Figure 4:
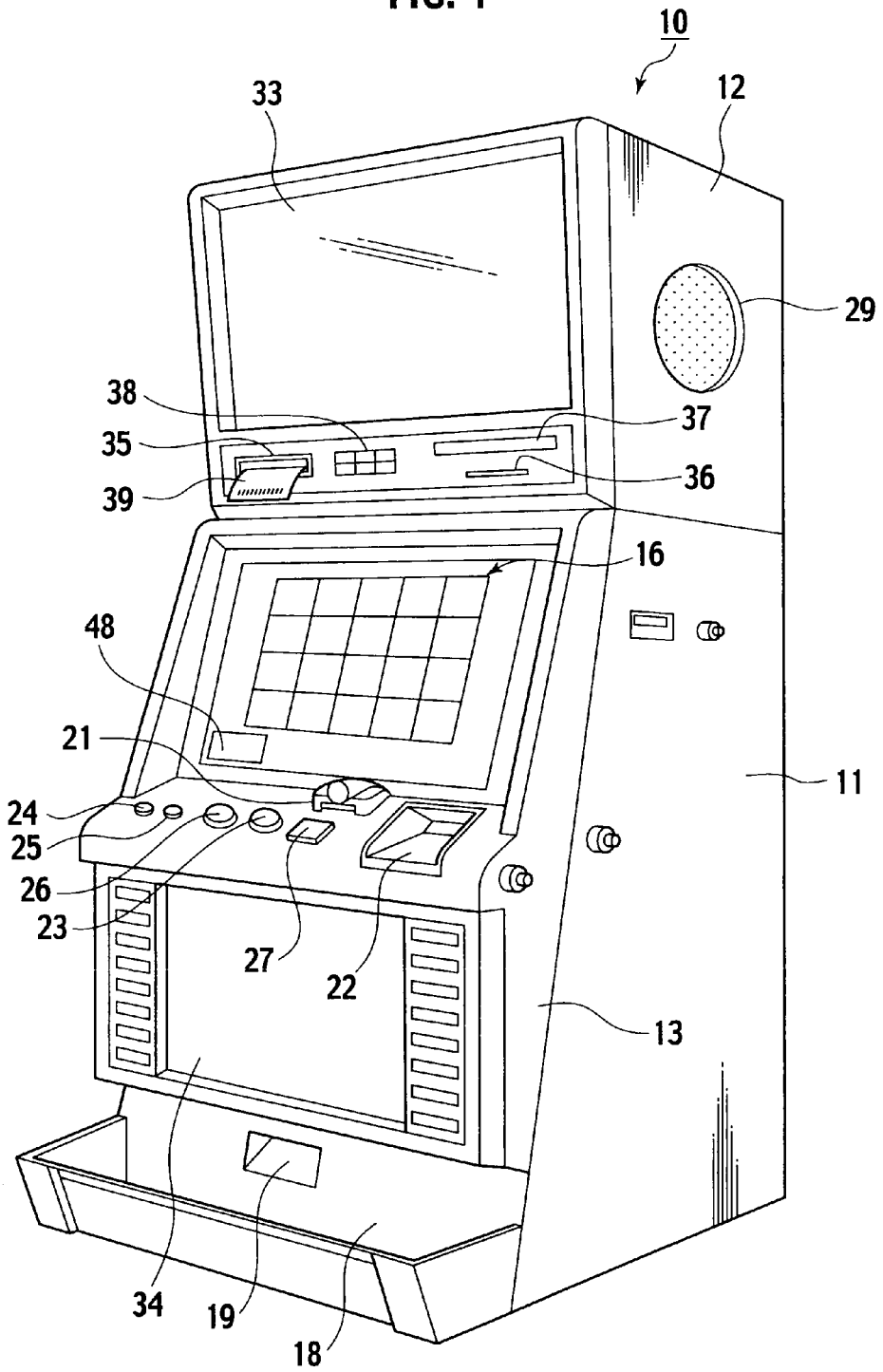
FIG. 4 is a perspective view of the slot machine according to the first embodiment of the present invention.
Figure 5:
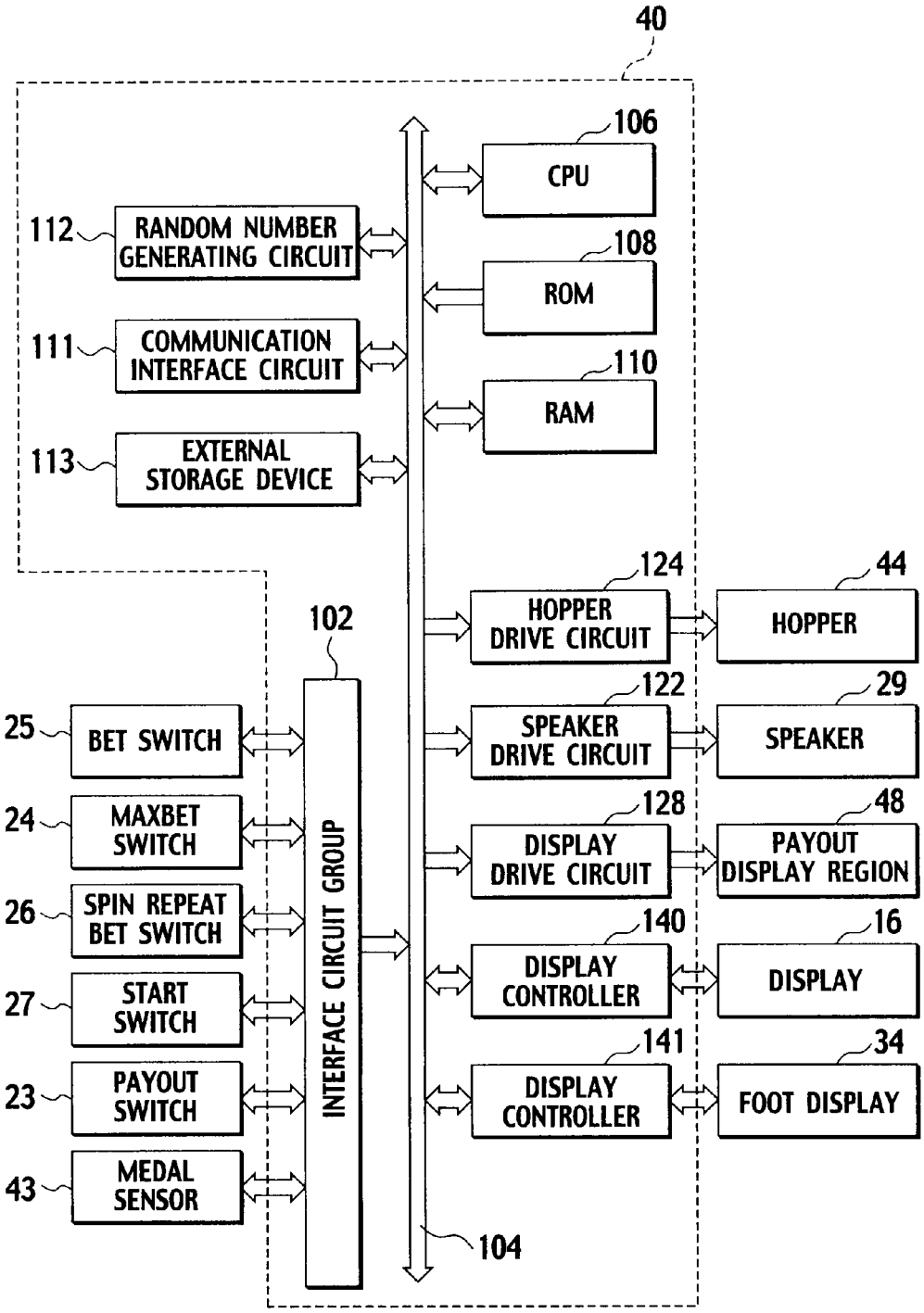
FIG. 5 is a block diagram showing a control circuit in the slot machine according to the first embodiment of the present invention.

FIG. 1A is a flowchart schematically showing a method for controlling a slot machine according to a first embodiment of the present invention. FIG. 2 is an explanatory view showing a display example displayed on a display in the slot machine according to the first embodiment of the present invention. FIG. 3 is an explanatory view showing partitioned regions in a matrix pattern provided on the display of the slot machine according to the first embodiment of the present invention. FIG. 4 is a perspective view of the slot machine according to the first embodiment of the present invention. FIG. 5 is a block diagram showing a control circuit in the slot machine according to the first embodiment of the present invention.

On a front surface of a cabinet 11 of a slot machine 10 shown in FIG. 4, a display 16 is provided. The display 16 has twenty partitioned regions q11 to q54 as shown in FIG. 3. These partitioned regions q11 to q54 are arranged in a matrix pattern including first to fifth columns and first to fourth rows.

In the slot machine 10 shown in FIG. 4 according to an example of the present invention, every time a unit game is played, symbols arranged as shown in FIG. 2 are rearranged, respectively, in the partitioned regions q11 to q54 shown in FIG. 3 described above. The unit game can be executed by rotating and stopping the symbols in the partitioned regions q11 to q54 of the display 16 such as a liquid crystal panel, for example.

As the symbols to be displayed on the display 16, for example, there are nine kinds of symbols, including "A (ace)", "K (king)", "Q (queen)", "J (jack)", "10", "umbrella", "lightning", "cloud" and "special (man's face)".

When the symbols are rearranged in each of the partitioned regions q11 to q54 in the unit game, an award of credits is determined according to rules of a predetermined payout table. Thereafter, a payout equivalent to the determined award of credits is provided. Subsequently, the symbols in the respective partitioned regions q11 to q54 are rearranged as the next unit game is started.

As shown in FIG. 1A, the slot machine 10 shown in FIG. 4 according to the example of the present invention displays such a unit game, in which the multiple having been arranged symbols are rearranged as described above, on the display 16 shown in FIG. 4 (Step S1).

The unit game can be executed by the player betting a wager. To be more specific, the wager can be bet by inserting medals or coins as cashable credits, which can be cashed in, into the slot machine 10 by the player. Alternatively, the wager can also be bet by appropriating an amount of restricted credits specified by the player to the wager by operating the slot machine 10. Specifically, the restricted credits are digitized and stored in the slot machine 10, and can be continuously used as the wager until the restricted credits are cashed in.

Note that, in the following description, a unit of the wager that can be bet by using the cashable credits or restricted credits described above is called "credit". For example, when one medal or coin is inserted as a wager into the slot machine 10 by the player, "1 credit" is bet as the wager. Moreover, for example, when two restricted credits are appropriated to a wager by the player operating the slot machine 10, "2 credits" are bet as the wager.

Next, in Step S2, the slot machine 10 determines whether or not a predetermined condition for executing a free game that is a special game is satisfied (Step S2) as shown in FIG. 1A. This free game that is the special game is also called a feature game. Specific examples of the case where the predetermined condition is satisfied include the case where three or more "special (man's face)" symbols are rearranged in the partitioned regions q11 to q54, and the like. Whether or not the predetermined condition is satisfied can be determined, for example, by whether or not a condition establishment lottery is won. Specifically, the condition establishment lottery is performed based on a random number generated by a random number generating circuit 112 shown in FIG. 5 every time the unit game is displayed on the display in Step S1.

If the predetermined condition is not satisfied in Step S2 (NO in Step S2), the slot machine 10 terminates a series of processes once and displays the unit game on the display again in Step S1, as shown in FIG. 1A.

On the other hand, if the predetermined condition is satisfied (YES in Step S2), the slot machine 10 displays a screen of the free game as the special game on the display 16 (Step S3). By using a margin around windows 16*a* to 16*e* on the display 16, the number of remaining games in the free game can also be displayed as a part of an image of the free game.

Thereafter, the slot machine 10 executes, as the free game that is the special game, slot games a predetermined number of play times (for example, 10) (Step S4). While executing the free game, the slot machine 10 emits a game sound specific to the free game, which is different from that of a normal unit game, from a speaker 29 (see FIGS. 4 and 5).

Subsequently, the slot machine 10 determines whether or not the predetermined condition for executing the free game that is the special game is satisfied again (retrigger) during the free game (Step S5).

As shown in FIG. 1A, if the predetermined condition is not satisfied in Step S5 (NO in Step S5), the slot machine 10 terminates the series of processes once and transitions to Step S4 to execute the free game when there are remaining games in the free game. When there are no remaining games in the free game, the slot machine 10 displays the unit game on the display again in Step S1.

On the other hand, if the predetermined condition is satisfied (YES in Step S5), the slot machine 10 changes the game sound of the free game (Step S6). To be more specific, the game sound is changed in the following manner. Specifically, sound data stored in an external storage device 113 (see FIG. 5) in the slot machine 10 is read and the read sound data is transmitted to a speaker drive circuit 122 (see FIG. 5). Thus, the game sound that has been emitted is changed to a game sound corresponding to the read sound data. For example, the game sound is changed by changing a song, a tempo and the like.

As a result of the processing described above, the slot machine 10 according to the first embodiment can notify the player that the player wins the free game again (retrigger), by changing the game sound in the free game.

Moreover, the slot machine 10 according to the embodiment of the present invention can change the song and tempo of the game sound if the player wins the free game again. Thus, the slot machine 10 can increase or maintain expectations of the player by changing the song and tempo of the game sound.

Next, detailed description will be given of the slot machine according to the first embodiment of the present invention. As shown in FIG. 4, the slot machine 10 according to this embodiment includes the cabinet 11, a top box 12 provided on the cabinet 11 and a main door 13 provided on the front surface of the cabinet 11. On a front side of the main door 13, the display 16 is provided. As shown in FIG. 3, the display 16 has twenty partitioned regions q11 to q54 arranged in a matrix pattern including first to fifth columns and first to fourth rows.

In each of the partitioned regions q11 to q54, any one of nine kinds of symbols, including "A (ace)", "K (king)", "Q (queen)", "J (jack)", "10", "umbrella", "lightning", "cloud" and "special (man's face)" is displayed.

In the slot machine 10 of this embodiment, one slot game (unit game) is executed by rearranging, as shown in FIG. 2, the symbols in the partitioned regions q11 to q54. This slot game can be generally executed by making a bet with game media. Meanwhile, as described later, the slot game can be executed without making a bet during a special game (free game) to be executed when a predetermined condition is satisfied.

Note that, in this embodiment, medals are taken as an example of the game media to be used for executing the slot game (except during the free game). However, the game media for the slot game are not limited to the medals but may include, for example, tokens, electronic money and electronic value information (credits) equivalent thereto.

Below the display 16, provided are: various input buttons 23 to 26 used by the player to input instructions related to a game process; a coin acceptor 21 for accepting coins; and a bill identifier 22 for identifying whether or not bills are eligible and accepting the legitimate bills. Note that the bill identifier 22 may be configured to be able to read a bar-coded ticket 39.

Moreover, in the vicinity of the medal insertion slot 21 and the bill identifier 22, various operation switches are provided. As the operation switches, a payout switch 23, a MAXBET switch 24, a BET switch 25, a spin repeat bet switch 26 and a start switch 27 are provided.

The BET switch 25 is a switch for determining the number of credits to be bet on the slot game to be executed on the display 16. As described later, every time the BET switch 25 is pressed, a credit equivalent to one medal is bet.

The spin repeat bet switch 26 is a switch for executing the slot game by betting again the same amount of credits as that bet in the previous game with BET switch 25 described above.

The start switch 27 is a switch for starting the slot game after a desired number of credits are bet. When the start switch 27 is pressed after medals are inserted into the medal insertion slot 21 or credits are bet by use of the BET switch 25, the slot game is started on the display 16.

The payout switch 23 is a switch for paying out the inserted medals. The medals to be paid out are discharged from a medal payout opening 19 provided in a lower front portion of the main door 13. The medals paid out are accumulated in a medal tray 18.

The MAXBET switch 24 is a switch for betting, in one operation, the maximum number of credits (for example, 30 medals) that can be bet on one slot game.

On a lower front surface of the main door 13, a foot display 34 is provided, which displays a predetermined screen on the basis of image display control data included in game software that is being executed.

On a front surface of the top box 12, an upper display 33 is provided. The upper display 33 includes a liquid crystal panel to display a payout table and the like.

Moreover, a speaker 29 is provided in the top box 12. Below the upper display 33, a ticket printer 35, a card reader 36, a data display 37 and a keypad 38 are provided. The ticket printer 35 prints out a bar-code on a ticket, the bar-code having coded data such as the number of credits, date and time and an identification number of the slot machine 10, and outputs the ticket as the bar-coded ticket 39.

The player can use the bar-coded ticket 39 to make a bet on a slot game with another slot machine by allowing the slot machine to read the bar-coded ticket 39 or can change the bar-coded ticket 39 for bills and the like at a predetermined location in a gaming facility (for example, a cashier in a casino).

The card reader 36 allows a smart card to be inserted thereinto, reads data from the inserted smart card and writes data into the smart card. The smart card is a card carried by the player and stores data for identifying the player and data on a history of games played by the player.

The smart card may store data corresponding to coins, bills or credits. Moreover, instead of the smart card, a magnetic stripe card may be employed. The data display 37 is formed of a fluorescent display or the like and displays, for example, the data read by the card reader 36 and data inputted by the player using the keypad 38.

Moreover, instead of the smart card, an RFID card capable of reading and writing data contactlessly may be used. The keypad 38 is for inputting instructions or data for ticketing and the like.

FIG. 5 is a block diagram showing a control circuit in the slot machine according to this embodiment. A machine controller 40 shown in FIG. 5 is a microcomputer, including an interface circuit group 102, an I/O bus 104, a CPU 106, a ROM 108, a RAM 110, a communication interface circuit 111, a random number generating circuit 112, an external storage device 113, a speaker drive circuit 122, a hopper drive circuit 124, a display drive circuit 128, and display controllers 140 and 141.

The interface circuit group 102 is connected to the I/O bus 104. The I/O bus 104 inputs and outputs a data signal or an address signal to and from the CPU 106.

The start switch 27 is connected to the interface circuit group 102. A start signal outputted from the start switch 27 is converted into a predetermined signal by the interface circuit group 102 and then transmitted to the CPU 106 through the I/O bus 104.

The BET switch 25, the MAXBET switch 24, the spin repeat bet switch 26 and the payout switch 23 are further connected to the interface circuit group 102. Each of switching signals outputted from the switches 23 to 26 is supplied to the interface circuit group 102, converted into a predetermined signal by the interface circuit group 102 and then transmitted to the CPU 106 through the I/O bus 104.

In addition, a medal sensor 43 is connected to the interface circuit group 102. The medal sensor 43 is a sensor for detecting medals inserted into the medal insertion slot 21 and is provided in a medal insertion part of the medal insertion slot 21. A detection signal outputted from the medal sensor 43 is supplied to the interface circuit group 102, converted into a predetermined signal by the interface circuit group 102 and then transmitted to the CPU 106 through the I/O bus 104.

The ROM 108 for storing system programs and the RAM 110 for storing various data are connected to the I/O bus 104. In the RAM 110, provided are areas for managing flags and storing various information, and the like.

The ROM 108 stores a payout table. The payout table shows conditions for generating a payout and the number of credits to be paid out when the condition is satisfied, and a correspondence relationship between the conditions. The conditions for generating a payout are determined by contents of the symbols rearranged in the partitioned regions q11 to q54 on the display 16. A symbol rearrangement mode to generate a payout can be determined by the number of scatter symbols rearranged in a slot game or a pattern of a winning combination formed on a payline set in the partitioned regions q11 to q54. In the slot game of this embodiment, the CPU 106 determines whether or not to generate a payout (whether or not to provide a payout for credits) and the credit payout amount (the number of credits for the payout) on the basis of the payout table and the symbols stopped in each of the partitioned regions q11 to q54.

Upon receipt of a game start operation from the start switch 27, the CPU 106 executes a slot game by reading a game execution program from the ROM 108. To be more specific, as a program for executing the slot game, the game execution program is programmed to execute the slot game in the following manner. Firstly, symbols are varied (scrolled) and displayed simultaneously in all the partitioned regions q11 to q54 on the display 16, and then the symbols are stopped from varying (scrolling). When the symbols are rearranged so as to form a pattern for providing a payout, the credits are provided according to the payout amount based on the payout table stored in the ROM 108.

The random number generating circuit 112, the communication interface circuit 111, the external storage device 113, the display controllers 140 and 141, the hopper drive circuit 124, the speaker drive circuit 122 and the display drive circuit 128 are further connected to the I/O bus 104.

The communication interface circuit 111 is connected to a hall server and the like and transmits, to the hall server, data on a history of plays executed in the slot machine 10. Moreover, the communication interface circuit 111 receives various data transmitted from the hall server.

The random number generating circuit 112 generates a random number for determining a winning combination or whether or not to generate a jackpot in a slot game executed on the display 16.

The external storage device (equivalent to a storage device in the claims) 113 stores sound data on a game sound to be emitted in the slot game. Moreover, the external storage device 113 also stores sound data on a game sound specific to a free game to be emitted in the free game executed as a special game when a predetermined condition is satisfied.

The display drive circuit 128 performs control of displaying the amount of payout in a payout amount defined region 48 set in the lower left area of the display 16.

The speaker drive circuit 122 outputs sound data to the speaker 29. Specifically, the CPU 106 reads sound data stored in the ROM 108 and the external storage device 113, and transmits the sound data to the speaker drive circuit 122 through the I/O bus 104. Thus, predetermined sound effects and game sounds are emitted from the speaker 29.

The hopper drive circuit 124 outputs a payout signal to the hopper 44 when a payout occurs. Specifically, when a payout signal is inputted by the payout switch 23, the CPU 106 outputs a drive signal to the hopper drive circuit 124 through the I/O bus 104. Thus, the hopper 44 pays out medals equivalent to the number of credits remaining at the time, which is stored in a predetermined memory region of the RAM 110.

Upon receipt of an image display command signal outputted by the CPU 106, the display controller 140 generates a drive signal for driving the display 16 on the basis of the image display command, and then outputs the generated drive signal to the display 16.

Upon receipt of the image display command signal outputted by the CPU 106, the display controller 140 creates two frame memories to be displayed so as to overlap with each other on the display 16 on the basis of the image display command, and then stores the frame memories in the RAM 110. A front frame memory being one of the two frame memories displays an image of a state where the partitioned regions q11 to q54 are being scrolled. Meanwhile, a rear frame memory being the other frame memory displays an image of the symbols determined by the CPU 106 so as to be rearranged in the partitioned regions q11 to q54.

Moreover, upon receipt of the image display command signal outputted by the CPU 106, the display controller 140 generates a drive signal for driving the display 16 on the basis of the image display command, and then outputs the generated drive signal to the display 16. The display controller 140 performs control of the symbols displayed on the rear frame memory so as to be individually viewed on the display 16 according to the drive signal. Thus, a predetermined image is displayed on the display 16.

The display controller 141 performs control of displaying a predetermined screen on the upper display 33. Specifically, the CPU 106 generates an image display command signal corresponding to the predetermined screen, and then outputs the image display command signal to the display controller 141 through the I/O bus 104. Upon receipt of the image display command signal outputted by the CPU 106, the display controller 141 generates a drive signal for driving the upper display 33 on the basis of the image display command, and then outputs the generated drive signal to the upper display 33. Thus, the predetermined screen is displayed on the upper display 33. The predetermined screen can be displayed by use of a still image or a moving image.

Figure 6:
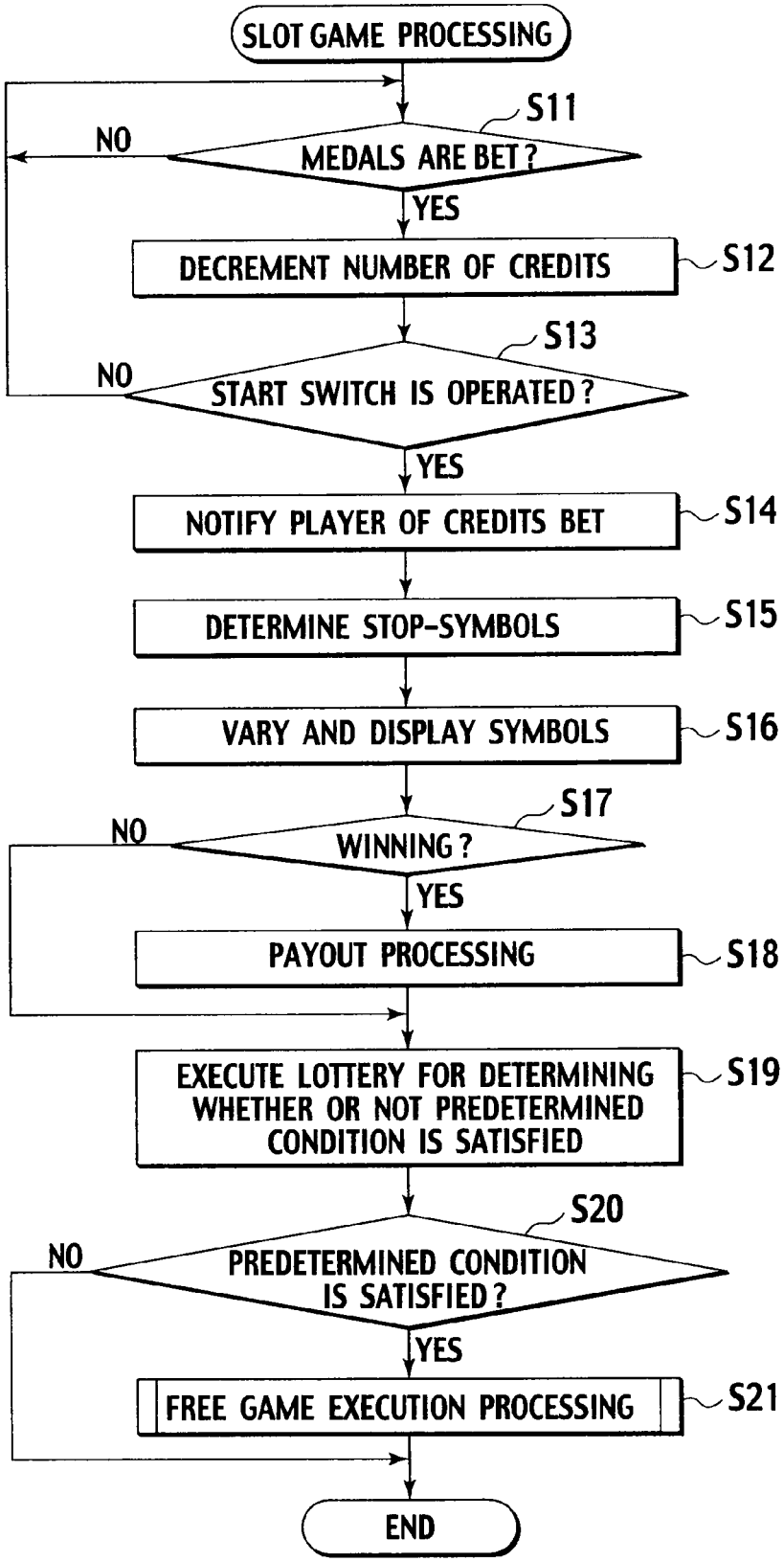
FIG. 6 is a flowchart showing slot game processing procedures executed by the slot machine according to the first embodiment of the present invention.
Figure 7:
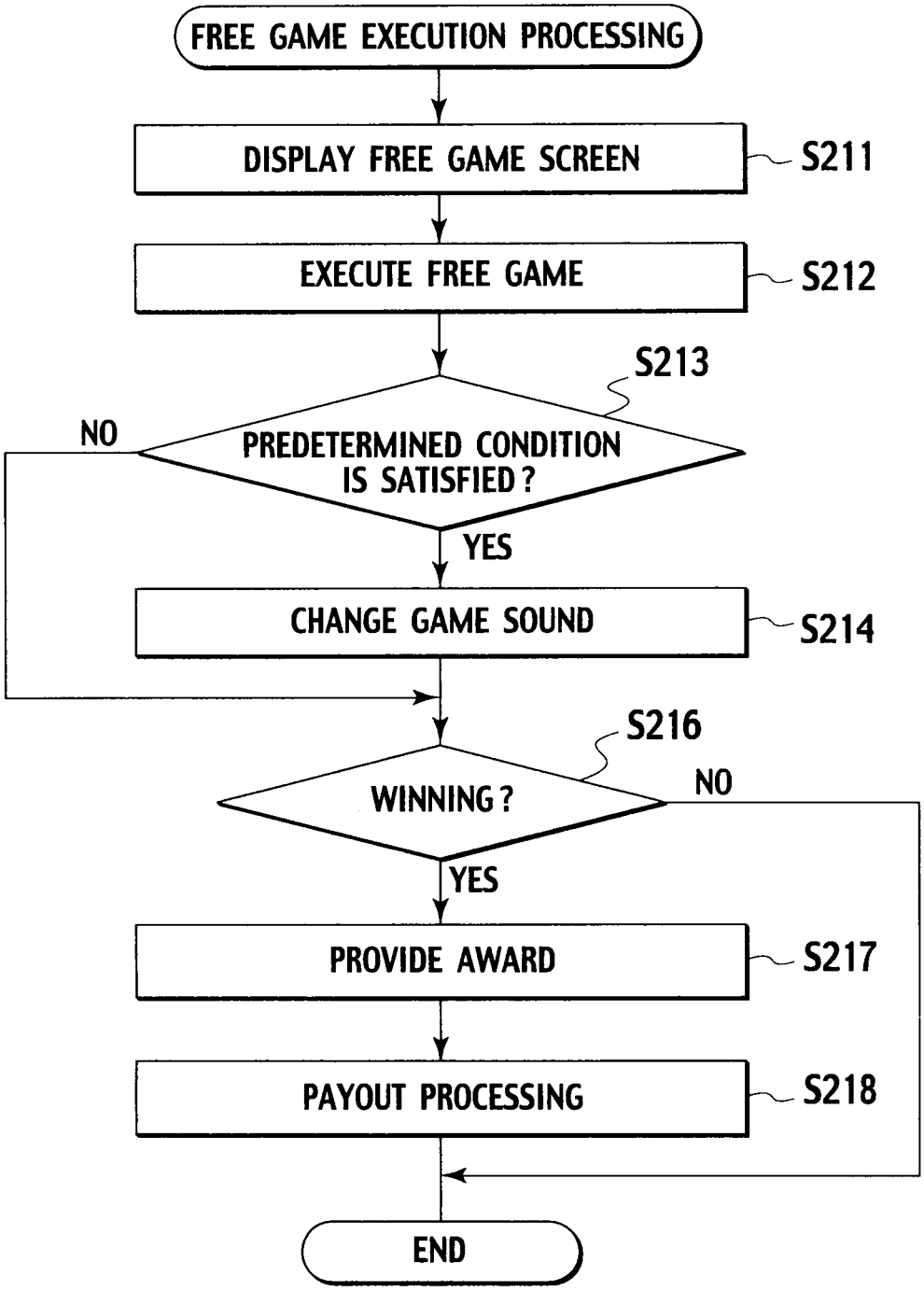
FIG. 7 is a flowchart showing free game execution processing procedures executed by the slot machine according to the first embodiment of the present invention.

Next, with reference to flowcharts shown in FIGS. 6 and 7, operations of the slot machine 10 according to this embodiment will be described. FIGS. 6 and 7 are the flowcharts showing procedures of slot game processing and free game execution processing, which are executed by the CPU 106 shown in FIG. 5 according to the game execution program stored in the ROM 108.

In the slot game processing shown in FIG. 6, first, the CPU 106 determines whether or not credits are bet in Step S11. In this processing, the CPU 106 determines whether or not the CPU 106 has received a signal outputted from the BET switch 25 when the BET switch 25 is pressed or a signal outputted from the MAXBET switch 24 when the MAXBET switch 24 is pressed. When the CPU 106 determines that no credits are bet, the processing returns to Step S11.

Meanwhile, when, in Step S11, the CPU 106 determines that the credits are bet, the CPU 106 transitions to Step S12 and decrements the number of credits stored in the RAM 110 according to the number of the credits bet.

Next, in Step S13, the CPU 106 determines whether or not the start switch 27 is pressed. In this processing, the CPU 106 determines whether or not a signal outputted from the start switch 27 when the start switch 27 is pressed is received.

When the CPU 106 determines that the start switch 27 is not pressed, the CPU 106 returns the processing to Step S11. Note that, when the start switch 27 is not pressed (for example, when an instruction to finish the game is inputted instead of pressing the start switch 27), the CPU 106 cancels a result of decrement of the number of credits in Step S12.

Meanwhile, when, in Step S13, the CPU 106 determines that the start switch 27 is pressed, the CPU 106 transitions to Step S14 from Step S13 and notifies a payout controller 3 of the number of the credits bet. At the same time, the CPU 106 determines stop-symbols in Step S15. In this stop-symbol determination processing, the CPU 106 determines the symbols to be stopped and displayed (rearranged) in the respective partitioned regions q11 to q54 by executing a stop-symbol determination program that is one of the game execution programs stored in the ROM 108.

By the stop-symbol determination processing, in the slot machine 10, the symbols to be rearranged in the partitioned regions q11 to q54 on the first to fifth columns shown in FIG. 3 are determined among the nine kinds of symbols including "A (ace)", "K (king)", "Q (queen)", "J (jack)", "10", "umbrella", "lightning", "cloud" and "special (man's face)".

Figure 8:
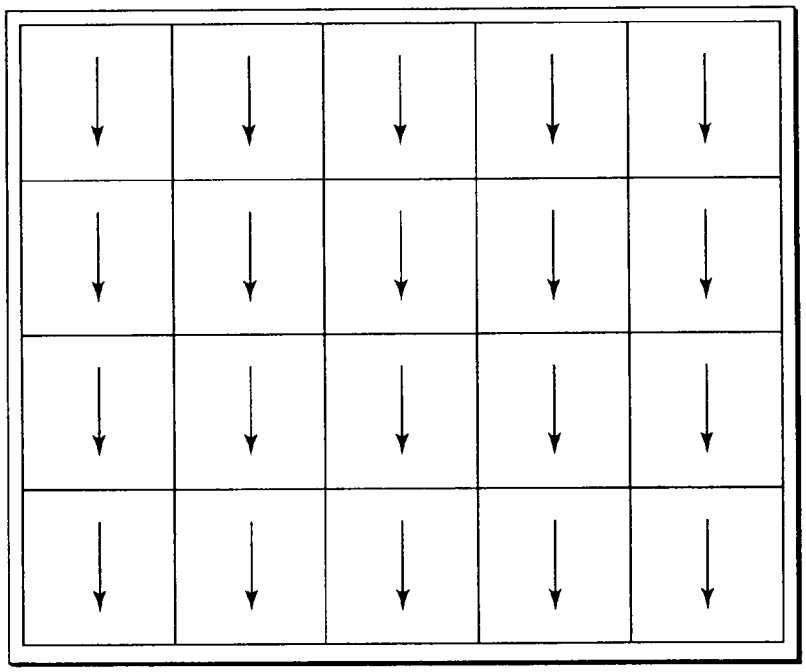
FIG. 8 is an explanatory view showing a display example of a slot game executed on the display in the slot machine according to the first embodiment of the present invention.
Figure 9:
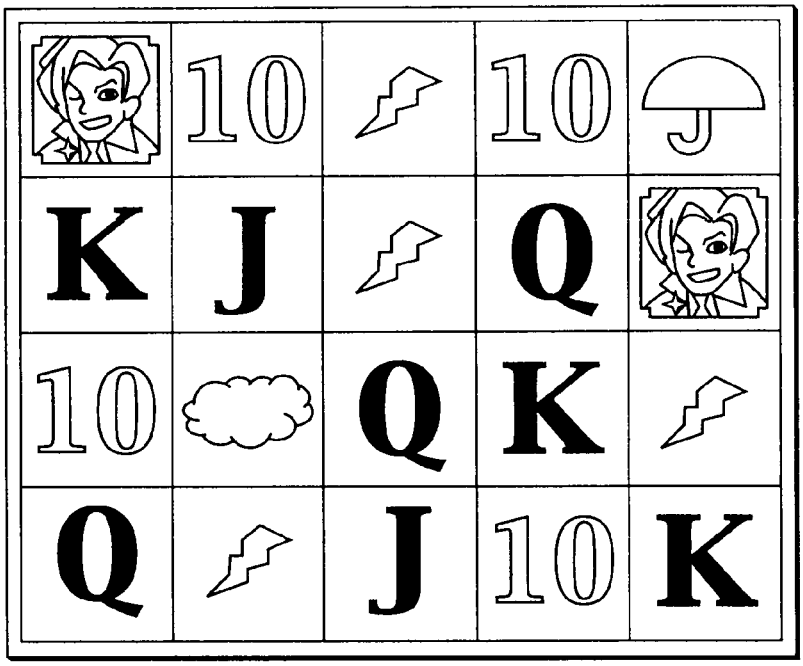
FIG. 9 is an explanatory view showing a display example of the slot game executed on the display in the slot machine according to the first embodiment of the present invention.

Next, the CPU 106 performs symbol varying (scrolling) and displaying processing in Step S16. In this processing, symbol varying (scrolling) and displaying is started in the partitioned regions q11 to q54 as shown in FIG. 8, and then is stopped in the partitioned regions q11 to q54 as shown in FIG. 9. By this processing of starting and stopping the symbol varying (scrolling) and displaying, the symbols are rearranged in the partitioned regions q11 to q54.

When the symbol varying (scrolling) and displaying processing is finished, the CPU 106 transitions to Step S17 and determines whether or not there is a winning on the basis of the symbols rearranged in the partitioned regions q11 to q54. Specifically, the CPU 106 determines whether or not a condition for providing an award is satisfied.

In Step S17, the CPU 106 refers to the payout table stored in the ROM 108 and determines whether or not a pattern of the symbols rearranged in Step S16 described above coincides with any one of symbol rearrangement modes to provide a payout, which are set in the payout table.

If the pattern of the rearranged symbols coincides with any one of the symbol rearrangement modes set in the payout table, a winning is considered to be established. Thus, the payout amount set so as to correspond to the symbol rearrangement mode is determined as the number of credits to be paid out. Thereafter, the processing transitions to the next Step S18 from Step S17.

Meanwhile, if the pattern of the symbols rearranged in Step S17 described above does not coincide with any one of the symbol rearrangement modes to provide a payout, which are set in the payout table, no winning is considered to be established. Thus, the CPU 106 transitions to Step S19 to be described later.

In Step S18, the CPU 106 executes processing of providing credits corresponding to a result of the winning in Step S16 described above. In this payout processing, the CPU 106 increments the number of credits to be paid out, which is obtained in Step S17 described above, to the number of credits stored in the RAM 110.

In Step S19, the CPU 106 uses a random number generated by the random number generating circuit 112 to perform a lottery for determining whether or not a predetermined condition for starting the free game is satisfied. Thereafter, in Step S20, the CPU 106 determines whether or not an outcome of the lottery satisfies the predetermined condition.

If the outcome of the lottery does not satisfy the predetermined condition (the condition is dissatisfied) (NO in Step S20), the CPU 106 returns to Step S11 described above to execute next slot game processing. If the outcome of the lottery satisfies the predetermined condition (YES in Step S20), the CPU 106 performs free game execution processing in Step S21 and then returns the processing to Step S11 described above to execute next slot game processing.

In the free game execution processing in Step S21, the CPU 106 generates a free game image display command signal and displays a free game screen on the display 16 in Step S211 as shown in FIG. 7 (Step S211). By using the margins around the windows 16*a* to 16*e* on the display 16, the number of remaining games in the free game can also be displayed as a part of the image of the free game.

Thereafter, the CPU 106 executes, as the free game, the slot game a predetermined number (for example, 10) of play times (Step S212). While executing the free game, the CPU 106 performs processing of reading sound data stored in the external storage device 113 and emitting a game sound specific to the free game, which is different from that of a normal unit game, from the speaker 29 (see FIGS. 4 and 5).

Subsequently, the CPU 106 determines whether or not the predetermined condition for executing the free game that is the special game is satisfied again (retrigger) during the free game (Step S213).

As shown in FIG. 7, if the predetermined condition is not satisfied in Step S213 (NO in Step S213), the CPU 106 determines that the predetermined condition is not satisfied, and then transitions to Step S216.

On the other hand, if the predetermined condition is satisfied (YES in Step S213), the CPU 106 changes the game sound of the free game (Step S214). To be more specific, the game sound is changed in the following manner. Specifically, the CPU 106 reads sound data stored in the external storage device 113, transmits the read sound data to the speaker drive circuit 122 and thus changes the game sound that has been emitted to a game sound corresponding to the read sound data. For example, the game sound is changed by changing a song, a tempo and the like.

Thereafter, the CPU 106 determines whether or not there is a winning on the basis of the symbols rearranged in the partitioned regions q11 to q54 in the free game (Step S216). Specifically, the CPU 106 determines whether or not a condition for providing an award is satisfied.

In Step S216, the CPU 106 refers to the payout table stored in the ROM 108 and determines whether or not a pattern of the symbols rearranged in the partitioned regions q11 to q54 coincides with anyone of symbol rearrangement modes to provide a payout, which are set in the payout table.

If the symbols rearranged in the partitioned regions q11 to q54 do not form a winning combination to provide the player with an award in the free game (NO in Step S216), the CPU 106 terminates a series of special game processing once.

On the other hand, if the pattern of the symbols rearranged coincides with any one of the symbol rearrangement modes set in the payout table (YES in Step S216), the CPU 106 determines that a winning is established and provides the player with an award (Step S217). Thereafter, the CPU 106 executes processing of providing the number of credits set so as to correspond to the award to be provided (Step S218). Subsequently, the CPU 106 terminates the free game execution processing.

As is clear from the above description, the CPU 106 in this embodiment forms a controller in the claims.

In the slot machine 10 according to this embodiment having the above configuration, a winning can occur again during the free game (retrigger). The slot machine 10 according to this embodiment can change the game sound when a retrigger occurs during the free game. Therefore, the slot machine 10 according to the first embodiment can notify the player that the retrigger occurs during the free game, by changing the game sound in the free game.

Moreover, the slot machine 10 according to the first embodiment can change the song and tempo of the game sound if the retrigger occurs during the free game. Thus, the slot machine 10 can increase or maintain expectations of the player by changing the song and tempo of the game sound.

Incidentally, in Step S214 of FIG. 7, the sound data stored in the external storage device 113 can also be provided, for example, in the program stored in the ROM 108 instead of being stored in the external storage device 113.

Second Embodiment

Next, a slot machine 10 according to a second embodiment of the present invention and a control method thereof will be described. The slot machine according to the second embodiment has substantially the same constituent members and the like as those of the slot machine 10 according to the first embodiment, and thus repetitive description will be omitted.

Figure 1B:
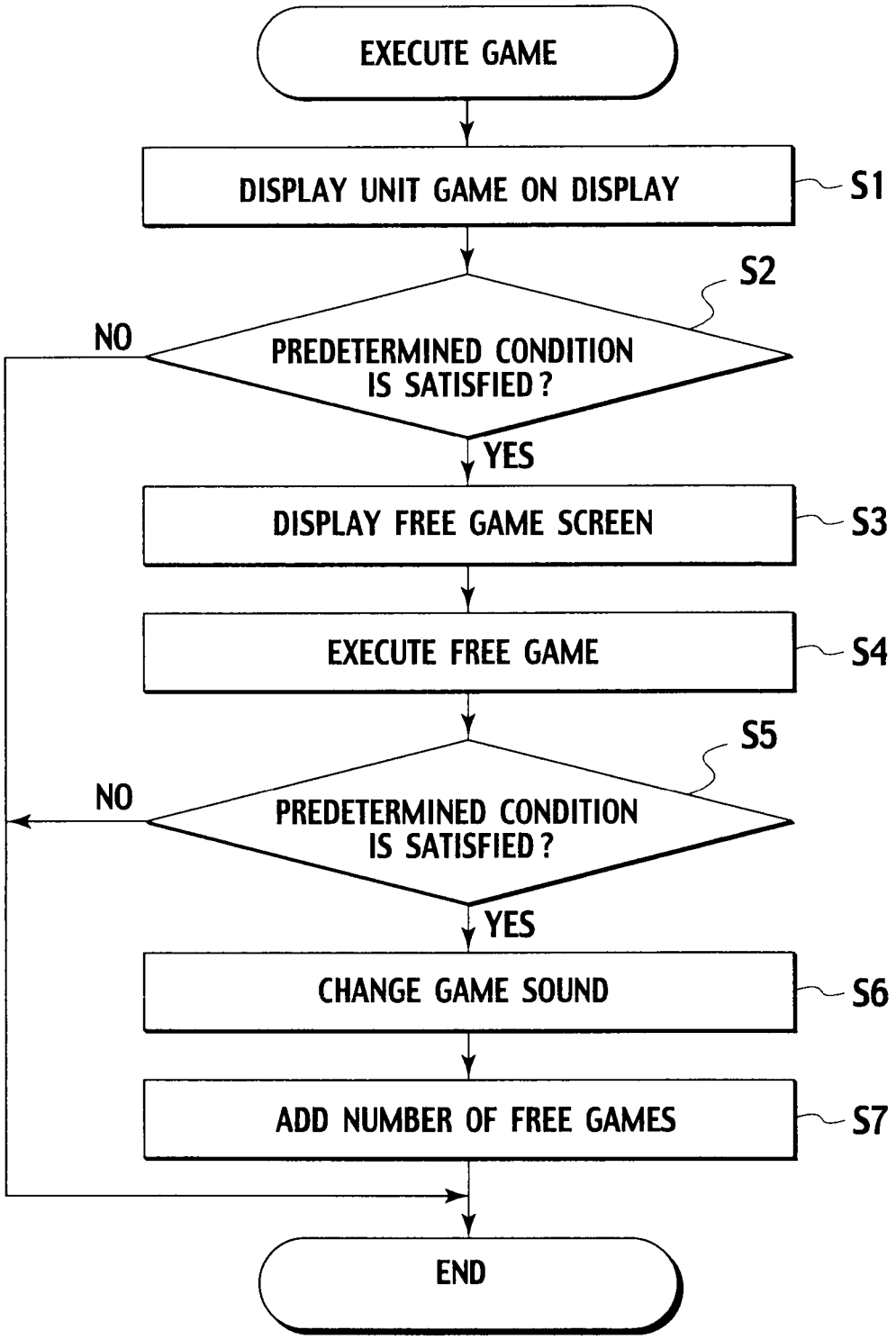
FIG. 1B is a flowchart schematically showing a slot machine and a control method thereof according to a second embodiment, which is another example of the slot machine of the present invention.

FIG. 1B is a flowchart schematically showing the method for controlling the slot machine according to the second embodiment of the present invention.

As shown in FIG. 1B, the slot machine 10 according to the second embodiment of the present invention displays a unit game, in which the multiple arranged symbols are rearranged, on the display 16 shown in FIG. 4 (Step S1).

Next, in Step S2, the slot machine 10 determines whether or not a predetermined condition for executing a free game that is a special game is satisfied (Step S2) as shown in FIG. 1B. Whether or not the predetermined condition is satisfied can be determined, for example, by whether or not a condition establishment lottery is won. Specifically, the condition establishment lottery is performed based on a random number generated by the random number generating circuit 112 shown in FIG. 5 every time the unit game is displayed on the display in Step S1.

If the predetermined condition is not satisfied in Step S2 (NO in Step S2), the slot machine 10 terminates a series of processes once and displays the unit game on the display again in Step S1, as shown in FIG. 1B.

On the other hand, if the predetermined condition is satisfied (YES in Step S2), the slot machine 10 displays a screen of the free game as the special game on the display 16 (Step S3). By using the margin around the windows 16*a* to 16*e* on the display 16, the number of remaining games in the free game can also be displayed as a part of the image of the free game.

Thereafter, the slot machine 10 executes, as the free game that is the special game, a slot game a predetermined number (for example, 10) of play times (Step S4). While executing the free game, the slot machine 10 emits a game sound specific to the free game, which is different from that of a normal unit game, from the speaker 29 (see FIGS. 4 and 5).

Subsequently, the slot machine 10 determines whether or not the predetermined condition for executing the free game that is the special game is satisfied again (retrigger) during the free game (Step S5).

As shown in FIG. 1B, if the predetermined condition is not satisfied in Step S5 (NO in Step S5), the slot machine 10 terminates the series of processes once and transitions to Step S4 to execute the free game when there are remaining games in the free game. When there are no remaining games in the free game, the slot machine 10 displays the unit game on the display again in Step S1.

On the other hand, if the predetermined condition is satisfied (YES in Step S5), the slot machine 10 changes the game sound of the free game (Step S6). To be more specific, the game sound is changed in the following manner. Specifically, sound data stored in the external storage device 113 (see FIG. 5) in the slot machine 10 is read and the read sound data is transmitted to the speaker drive circuit 122 (see FIG. 5). Thus, the game sound that has been emitted is changed to a game sound corresponding to the read sound data. For example, the game sound is changed by changing a song, a tempo and the like.

Subsequently, the slot machine 10 increments a predetermined number (for example, 10) of slot games to be executed as the free game (Step S7). For example, when a condition for incrementing 10 games is satisfied with the number of 5 being remaining games in the free game, the slot machine 10 performs processing of setting the number of remaining games to 15 by incrementing the number of games in the free game.

As a result of the processing described above, the slot machine 10 according to the second embodiment can notify the player that the player wins the free game again (retrigger), by changing the game sound in the free game.

Moreover, the slot machine 10 according to the embodiment of the present invention can change the song and tempo of the game sound if the retrigger occurs during the free game. Thus, the slot machine 10 can increase or maintain expectations of the player by changing the song and tempo of the game sound.

Moreover, the slot machine 10 according to the embodiment of the present invention can increment the number of games in the free game if the retrigger occurs during the free game. Thus, the slot machine 10 according to the embodiment of the present invention can notify the player that the number of games in the free game is increased, by changing the game sound.

Next, operations of the slot machine 10 according to this embodiment will be described. Note that slot game processing executed by the slot machine 10 shown in FIG. 6 is substantially the same as that of the first embodiment, and thus description thereof will be omitted.

Figure 10:
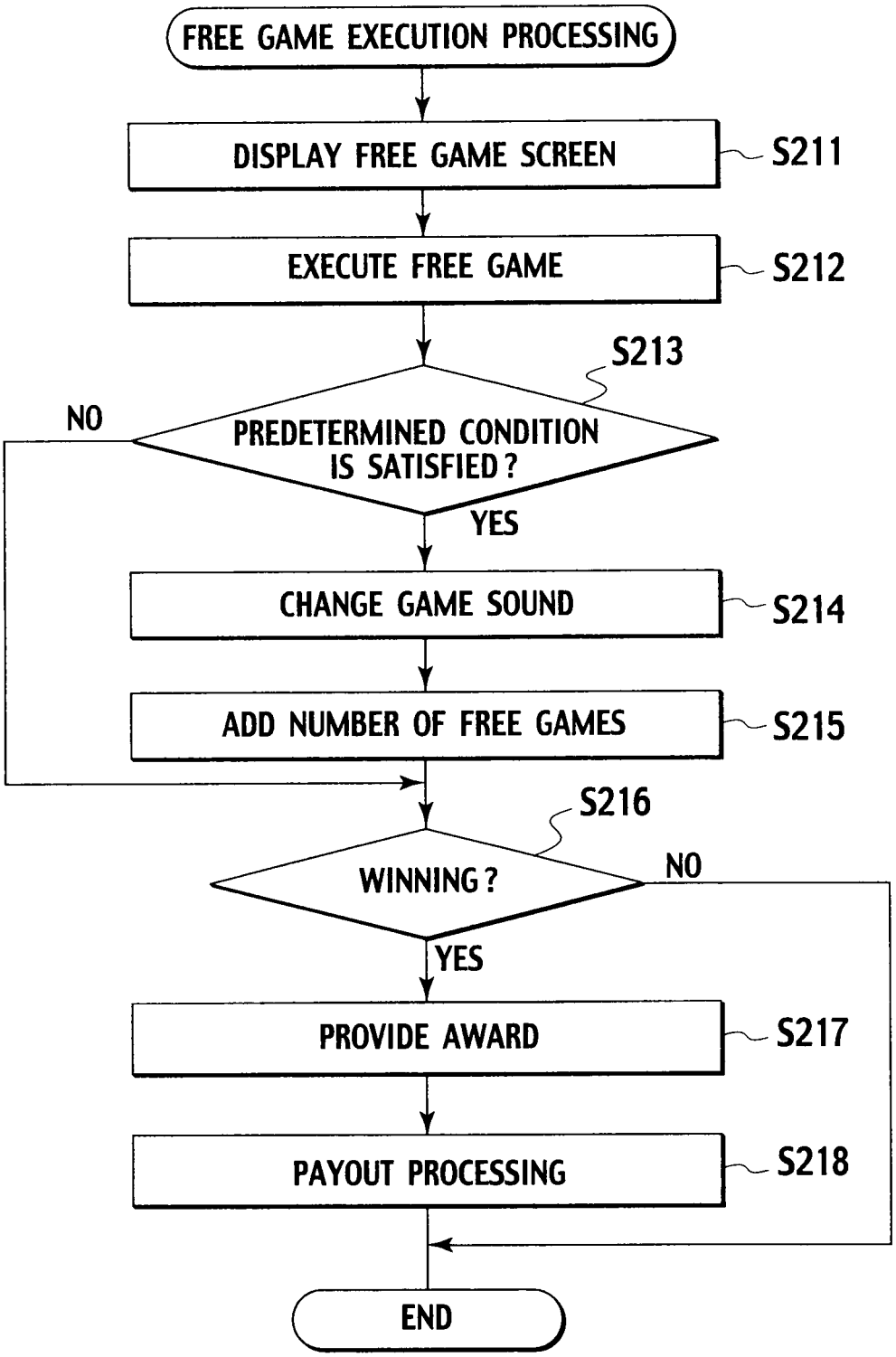
FIG. 10 is a flowchart showing free game execution processing procedures executed by the slot machine according to the second embodiment of the present invention.

With reference to a flowchart shown in FIG. 10, free game execution processing executed by the slot machine 10 according to this embodiment will be described below. FIG. 10 is the flowchart showing procedures of the free game execution processing.

In the free game execution processing in Step S21 of FIG. 6, as shown in FIG. 10, the CPU 106 generates a free game image display command signal and displays a free game screen on the display 16 (Step S211). By using the margin around the windows 16*a* to 16*e* on the display 16, the number of remaining games in the free game can also be displayed as a part of the image of the free game.

Thereafter, the CPU 106 executes, as the free game, the slot game a predetermined number (for example, 10) of play times (Step S212). While executing the free game, the CPU 106 performs processing of reading sound data stored in the external storage device 113 and emitting a game sound specific to the free game, which is different from that of a normal unit game, from the speaker 29 (see FIGS. 4 and 5).

Subsequently, the CPU 106 determines whether or not the predetermined condition for executing the free game that is the special game is satisfied again (retrigger) during the free game (Step S213).

As shown in FIG. 10, if the predetermined condition is not satisfied in Step S213 (NO in Step S213), the CPU 106 determines that the predetermined condition is not satisfied and transitions to Step S216.

On the other hand, if the predetermined condition is satisfied (YES in Step S213), the CPU 106 changes the game sound of the free game (Step S214). To be more specific, the game sound is changed in the following manner. Specifically, the CPU 106 reads sound data stored in the external storage device 113, transmits the read sound data to the speaker drive circuit 122 and thus changes the game sound that has been emitted to a game sound corresponding to the read sound data. For example, the game sound is changed by changing a song, a tempo and the like.

Subsequently, the CPU 106 increments a predetermined number (for example, 10) of slot games to be executed as the free game (Step S215). For example, when a condition for incrementing 10 games is satisfied when the number of remaining games in the free game is 5, the slot machine 10 performs processing of setting the number of remaining games to 15 by incrementing the number of games in the free game.

Thereafter, the CPU 106 determines whether or not there is a winning on the basis of the symbols rearranged in the partitioned regions q11 to q54 in the free game (Step S216). Specifically, the CPU 106 determines whether or not a condition for providing an award is satisfied.

In Step S216, the CPU 106 refers to the payout table stored in the ROM 108 and determines whether or not a pattern of the symbols rearranged in the partitioned regions q11 to q54 coincides with anyone of symbol rearrangement modes to provide a payout, which are set in the payout table.

If the symbols rearranged in the partitioned regions q11 to q54 do not form a winning combination to provide the player with an award in the free game (NO in Step S216), the CPU 106 terminates a series of special game processing once.

On the other hand, if the pattern of the symbols rearranged coincides with any one of the symbol rearrangement modes set in the payout table (YES in Step S216), the CPU 106 determines that a winning is established and provides the player with an award (Step S217). Thereafter, the CPU 106 executes processing of providing the number of credits set so as to correspond to the award to be provided (Step S218). Subsequently, the CPU 106 terminates the free game execution processing.

As is clear from the above description, the CPU 106 in this embodiment forms a controller in the claims.

In the slot machine 10 according to this embodiment having the above configuration, a winning can occur again during the free game (retrigger). The slot machine 10 according to this embodiment can change the game sound when a retrigger occurs during the free game. Therefore, the slot machine 10 according to the second embodiment can notify the player that the retrigger occurs during the free game, by changing the game sound in the free game.

Moreover, the slot machine 10 according to the second embodiment can change the song and tempo of the game sound if the retrigger occurs during the free game. Thus, the slot machine 10 can increase or maintain expectations of the player by changing the song and tempo of the game sound.

Moreover, the slot machine 10 according to the second embodiment can increment the number of games in the free game if the retrigger occurs during the free game. Thus, the slot machine 10 according to the embodiment of the present invention can notify the player that the number of games in the free game is increased, by changing the game sound.

Third Embodiment

Next, a slot machine 10 according to a third embodiment of the present invention and a control method thereof will be described. The slot machine according to the third embodiment has substantially the same constituent members and the like as those of the slot machine 10 according to the first embodiment, and thus repetitive description will be omitted.

Figure 1C:
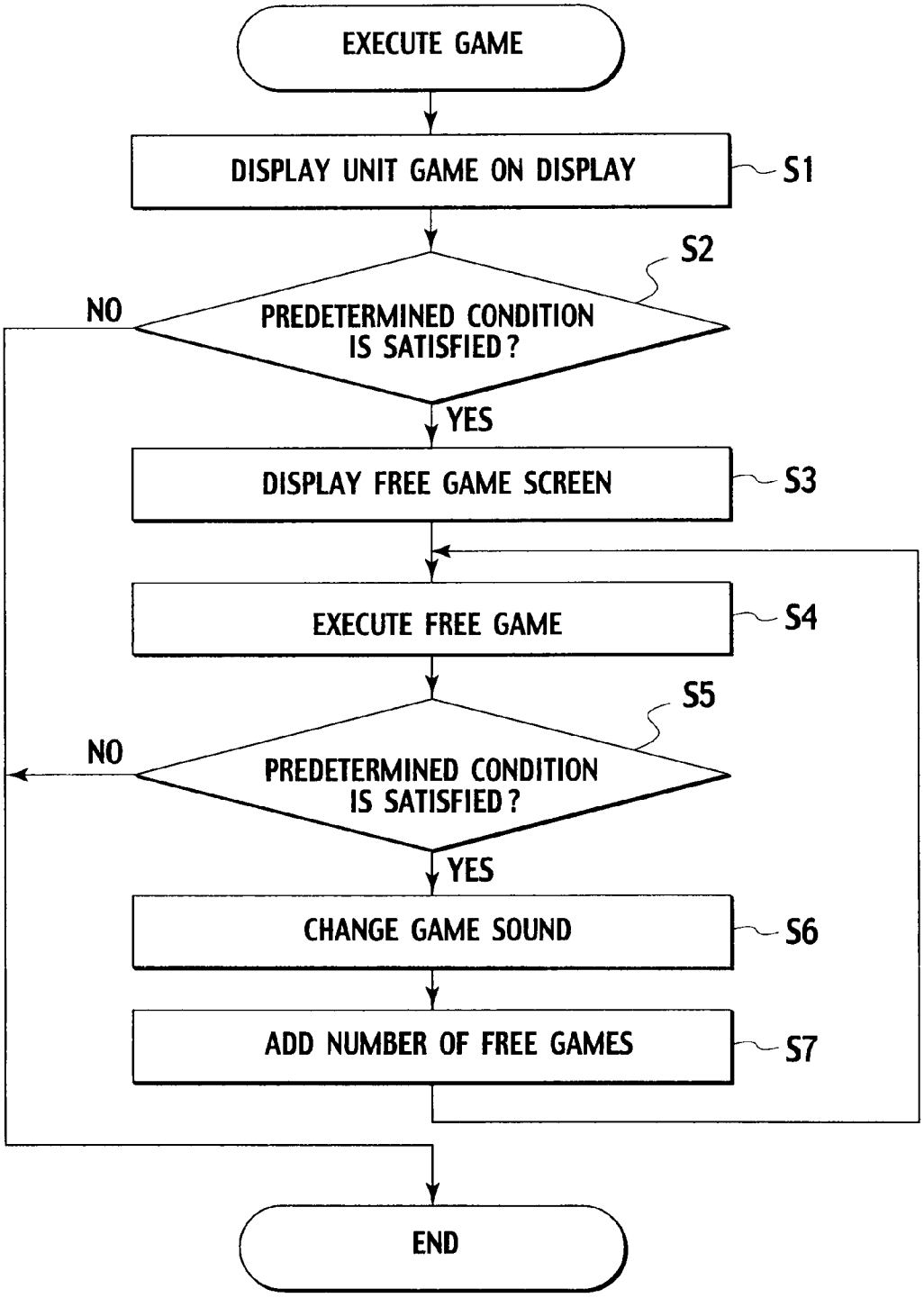
FIG. 1C is a flowchart schematically showing a slot machine and a control method thereof according to a third embodiment, which is still another example of the slot machine of the present invention.

FIG. 1C is a flowchart schematically showing the method for controlling the slot machine according to the third embodiment of the present invention.

As shown in FIG. 1C, the slot machine 10 according to the third embodiment of the present invention displays a unit game, in which the multiple arranged symbols are rearranged, on the display 16 shown in FIG. 4 (Step S1).

Next, in Step S2, the slot machine 10 determines whether or not a predetermined condition for executing a free game that is a special game is satisfied (Step S2) as shown in FIG. 1C. Whether or not the predetermined condition is satisfied can be determined, for example, by whether or not a condition establishment lottery is won. Specifically, the condition establishment lottery is performed based on a random number generated by the random number generating circuit 112 shown in FIG. 5 every time the unit game is displayed on the display in Step S1.

If the predetermined condition is not satisfied in Step S2 (NO in Step S2), the slot machine 10 terminates a series of processes once and displays the unit game on the display again in Step S1, as shown in FIG. 1C.

On the other hand, if the predetermined condition is satisfied (YES in Step S2), the slot machine 10 displays a screen of the free game as the special game on the display 16 (Step S3). By using the margin around the windows 16*a* to 16*e* on the display 16, the number of remaining games in the free game can also be displayed as a part of the image of the free game.

Thereafter, the slot machine 10 executes, as the free game that is the special game, a slot game a predetermined number (for example, 10) of play times (Step S4). While executing the free game, the slot machine 10 emits a game sound specific to the free game, which is different from that of a normal unit game, from the speaker 29 (see FIGS. 4 and 5).

Subsequently, the slot machine 10 determines whether or not the predetermined condition for executing the free game that is the special game is satisfied again (retrigger) during the free game (Step S5).

As shown in FIG. 1C, if the predetermined condition is not satisfied in Step S5 (NO in Step S5), the slot machine 10 terminates the series of processes once and transitions to Step S4 to execute the free game when there are remaining games in the free game. When there are no remaining games in the free game, the slot machine 10 displays the unit game on the display again in Step S1.

On the other hand, if the predetermined condition is satisfied (YES in Step S5), the slot machine 10 changes the game sound of the free game (Step S6). To be more specific, the game sound is changed in the following manner. Specifically, sound data stored in the external storage device 113 (see FIG. 5) in the slot machine 10 is read and the read sound data is transmitted to the speaker drive circuit 122 (see FIG. 5). Thus, the game sound that has been emitted is changed to a game sound corresponding to the read sound data. For example, the game sound is changed by changing a song, a tempo and the like.

Subsequently, the slot machine 10 increments a predetermined number (for example, 10) of slot games to be executed as the free game (Step S7). For example, when a condition for incrementing 10 games is satisfied with the number of 5 being remaining games in the free game, the slot machine 10 performs processing of setting the number of remaining games to 15 by incrementing the number of games in the free game.

Thereafter, the slot machine 10 transitions to Step S4 and repeats Steps S4 to S7. By repeating Steps S4 to S7, the slot machine 10 performs processing of changing the game sound and incrementing the number of games every time the retrigger occurs during the free game.

As a result of the processing described above, the slot machine 10 according to the third embodiment can notify the player that the player wins the free game again (retrigger) during the free game, by changing the game sound in the free game.

Moreover, the slot machine 10 according to the embodiment of the present invention can change the song and tempo of the game sound if the retrigger occurs during the free game. Thus, the slot machine 10 can increase or maintain expectations of the player by changing the song and tempo of the game sound.

Moreover, the slot machine 10 according to the embodiment of the present invention can increment the number of games in the free game if the retrigger occurs during the free game. Thus, the slot machine 10 according to the embodiment of the present invention can notify the player that the number of games in the free game is increased, by changing the game sound.

Moreover, in a case where more than one retrigger occurs during the free game, the slot machine 10 according to the embodiment of the present invention can perform, the processing of changing the game sound and incrementing the number of games every time the retrigger occurs. Therefore, the slot machine 10 according to the embodiment of the present invention can notify the player that the number of games in the free game is increased more than once, by changing the game sound more than once.

Next, operations of the slot machine 10 according to this embodiment will be described. Note that slot game processing executed by the slot machine 10 shown in FIG. 6 is substantially the same as that of the first embodiment, and thus description thereof will be omitted.

Figure 11:
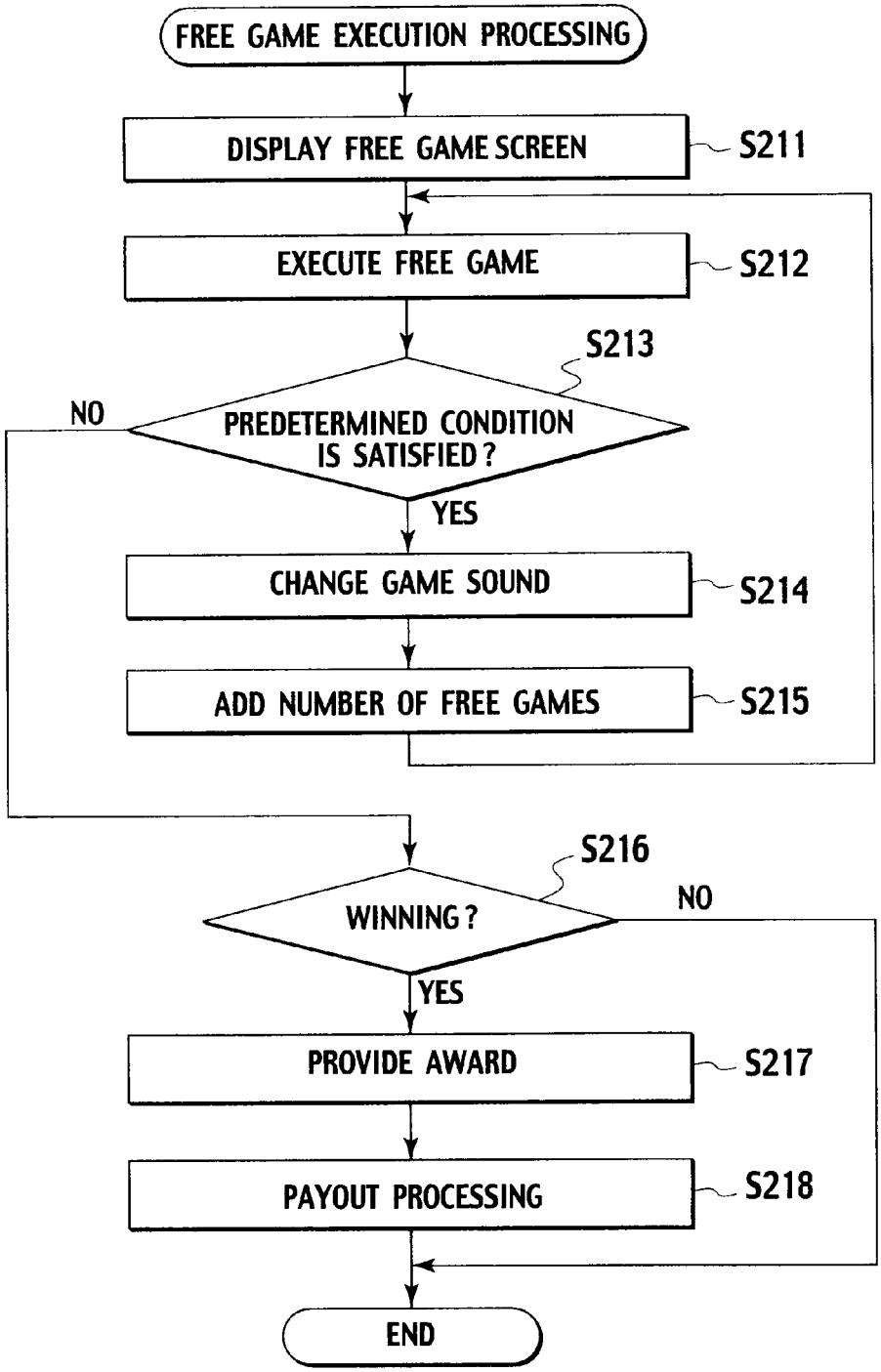
FIG. 11 is a flowchart showing free game execution processing procedures executed by the slot machine according to the third embodiment of the present invention.

With reference to a flowchart shown in FIG. 11, free game execution processing executed by the slot machine 10 according to this embodiment will be described below. FIG. 11 is the flowchart showing procedures of the free game execution processing.

In the free game execution processing in Step S21 of FIG. 6, as shown in FIG. 11, the CPU 106 generates a free game image display command signal and displays a free game screen on the display 16 (Step S211). By using the margin around the windows 16*a* to 16*e* on the display 16, the number of remaining games in the free game can also be displayed as a part of the image of the free game.

Thereafter, the CPU 106 executes, as the free game, the slot game a predetermined number (for example, 10) of play times (Step S212). While executing the free game, the CPU 106 performs processing of reading sound data stored in the external storage device 113 and emitting a game sound specific to the free game, which is different from that of a normal unit game, from the speaker 29 (see FIGS. 4 and 5).

Subsequently, the CPU 106 determines whether or not the predetermined condition for executing the free game that is the special game is satisfied again (retrigger) during the free game (Step S213).

As shown in FIG. 11, if the predetermined condition is not satisfied in Step S213 (NO in Step S213), the CPU 106 determines that the predetermined condition is not satisfied and transitions to Step S216.

On the other hand, if the predetermined condition is satisfied (YES in Step S213), the CPU 106 changes the game sound of the free game (Step S214). To be more specific, the game sound is changed in the following manner. Specifically, the CPU 106 reads sound data stored in the external storage device 113, transmits the read sound data to the speaker drive circuit 122 and thus changes the game sound that has been emitted to a game sound corresponding to the read sound data. For example, the game sound is changed by changing a song, a tempo and the like.

Subsequently, the CPU 106 increments a predetermined number (for example, 10) of slot games to be executed as the free game (Step S215). For example, when a condition for incrementing 10 games is satisfied when the number of remaining games in the free game is 5, the slot machine 10 performs processing of setting the number of remaining games to 15 by incrementing the number of games in the free game.

Thereafter, the CPU 106 transitions to Step S212 and repeats Steps S212 to S215. By repeating Steps S212 to S215, the CPU 106 performs processing of changing the game sound and incrementing the number of games every time the retrigger occurs during the free game.

Thereafter, the CPU 106 determines whether or not there is a winning on the basis of the symbols rearranged in the partitioned regions q11 to q54 in the free game (Step S216). Specifically, the CPU 106 determines whether or not a condition for providing an award is satisfied.

In Step S216, the CPU 106 refers to the payout table stored in the ROM 108 and determines whether or not a pattern of the symbols rearranged in the partitioned regions q11 to q54 coincides with any one of symbol rearrangement modes to provide a payout, which are set in the payout table.

If the symbols rearranged in the partitioned regions q11 to q54 do not form a winning combination to provide the player with an award in the free game (NO in Step S216), the CPU 106 terminates a series of special game processing once.

On the other hand, if the pattern of the symbols rearranged coincides with any one of the symbol rearrangement modes set in the payout table (YES in Step S216), the CPU 106 determines that a winning is established and provides the player with an award (Step S217). Thereafter, the CPU 106 executes processing of providing the number of credits set so as to correspond to the award to be provided (Step S218). Subsequently, the CPU 106 terminates the free game execution processing.

As is clear from the above description, the CPU 106 in this embodiment forms a controller in the claims.

In the slot machine 10 according to this embodiment having the above configuration, a winning can occur again during the free game (retrigger). The slot machine 10 according to this embodiment can change the game sound when a retrigger occurs during the free game. Therefore, the slot machine 10 according to the third embodiment can notify the player that the retrigger occurs during the free game, by changing the game sound in the free game.

Moreover, the slot machine 10 according to the third embodiment can change the song and tempo of the game sound if the retrigger occurs during the free game. Thus, the slot machine 10 can increase or maintain expectations of the player by changing the song and tempo of the game sound.

Moreover, the slot machine 10 according to the third embodiment can increment the number of games in the free game if the retrigger occurs during the free game. Thus, the slot machine 10 according to the embodiment of the present invention can notify the player that the number of games in the free game is increased, by changing the game sound.

Moreover, in a case where more than one retrigger occurs during the free game, the slot machine 10 according to the third embodiment can perform the processing of changing the game sound and incrementing the number of games every time the retrigger occurs. Therefore, the slot machine 10 according to the embodiment of the present invention can notify the player that more than one retrigger occurs and the number of games in the free game is increased more than once, by changing the game sound more than once.

Fourth Embodiment

In each of the first to third embodiments described above, the display 16 is a liquid crystal panel and rearrangement of the symbols in the partitioned regions q11 to q54 is performed by use of the liquid crystal panel. However, rearrangement of the symbols in the partitioned regions q11 to q54 on the display 16 can also be performed by providing the display with a liquid crystal panel capable of transparent display and by using a rotating reel device disposed behind the display.

Figure 12:
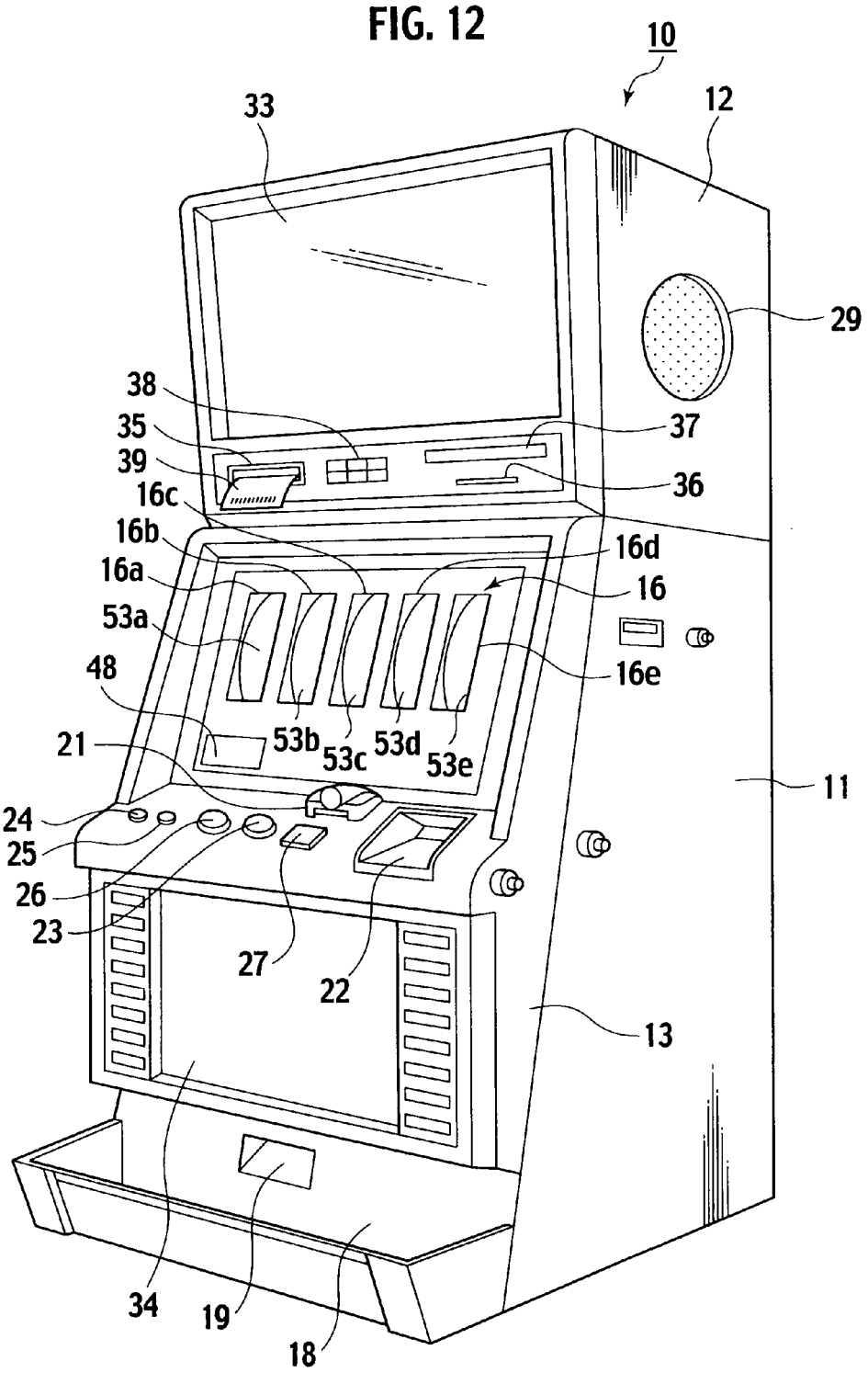
FIG. 12 is a perspective view of a slot machine according to a fourth embodiment of the present invention.
Figure 13:
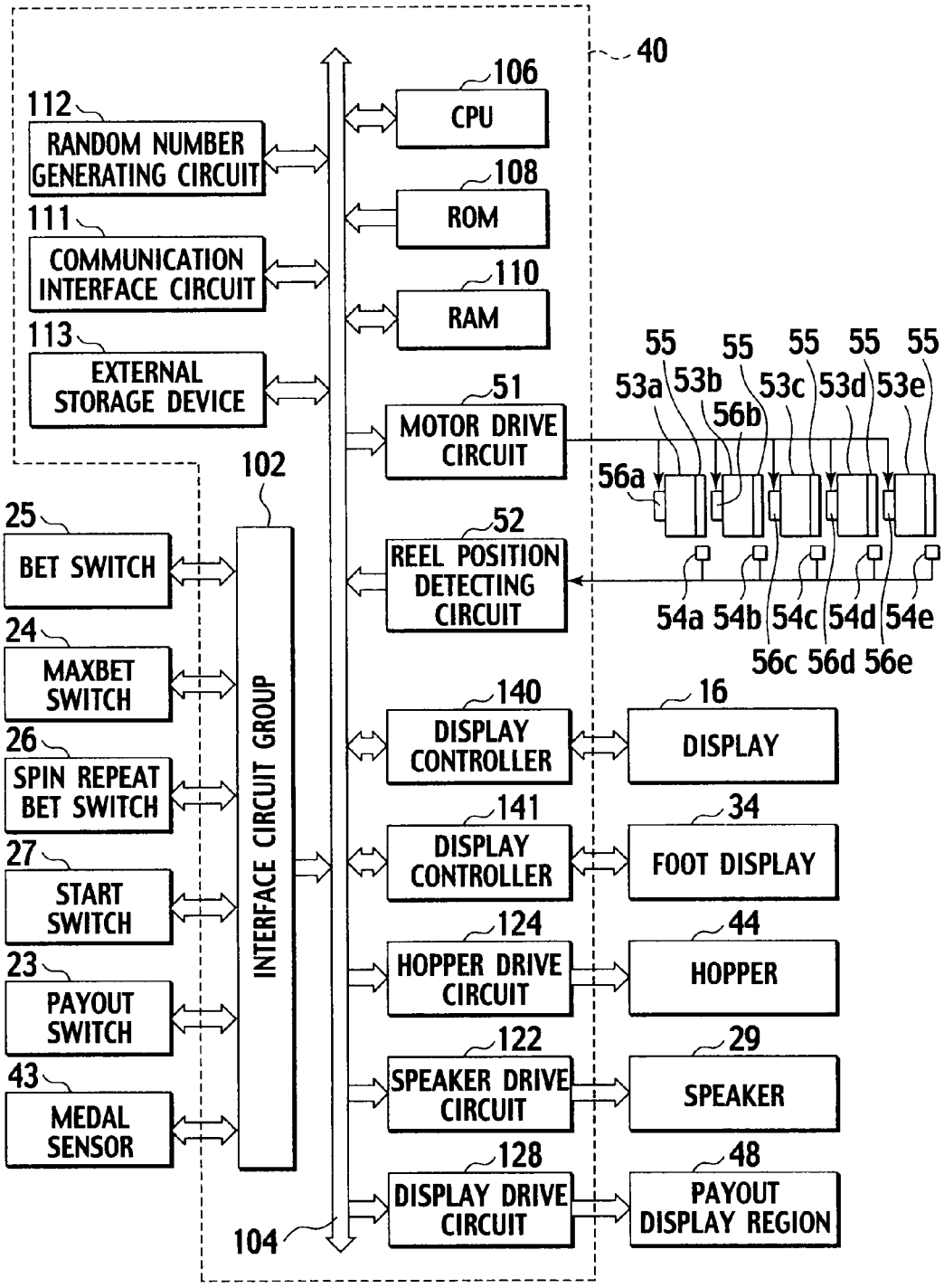
FIG. 13 is a block diagram showing a control circuit in the slot machine according to the fourth embodiment of the present invention.
Figure 14A:
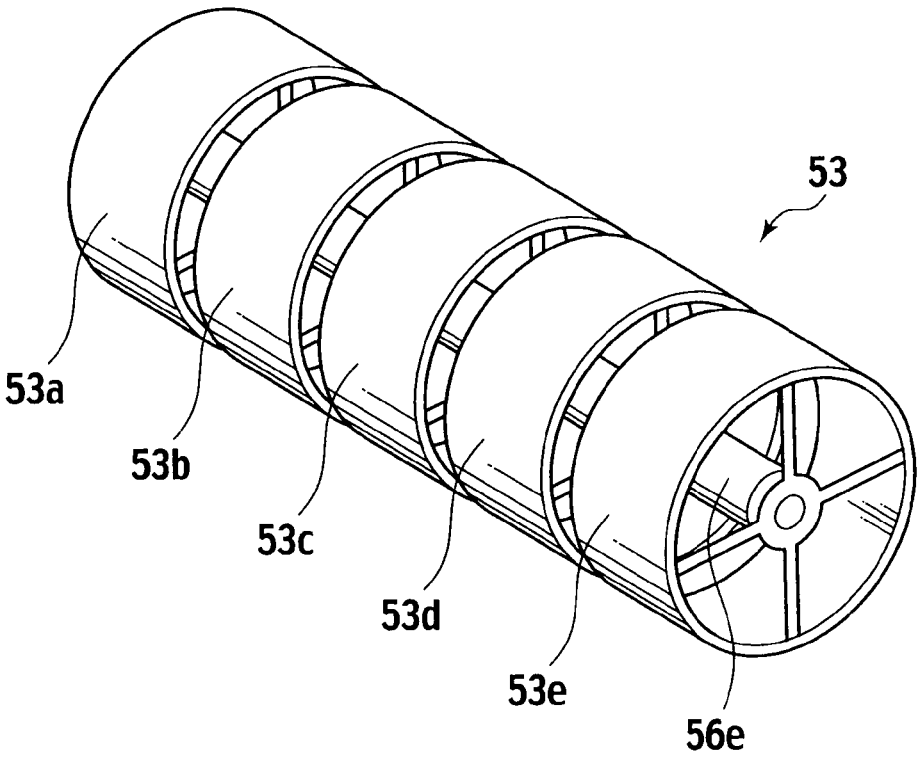
FIG. 14A is a perspective view showing a rotating reel device in the slot machine according to the fourth embodiment of the present invention.
Figure 14B:
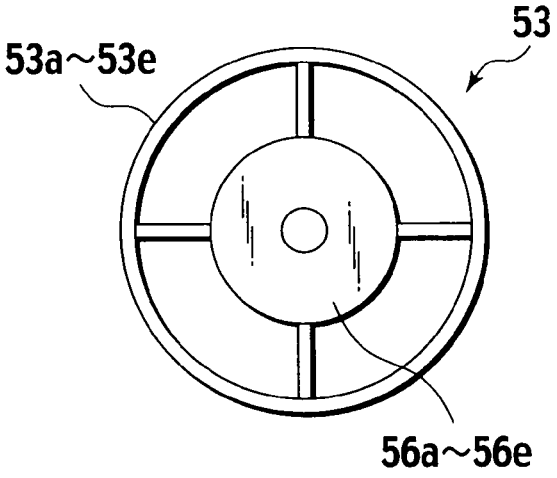
FIG. 14B is a side view showing the rotating reel device in the slot machine according to the fourth embodiment of the present invention.
Figure 15:
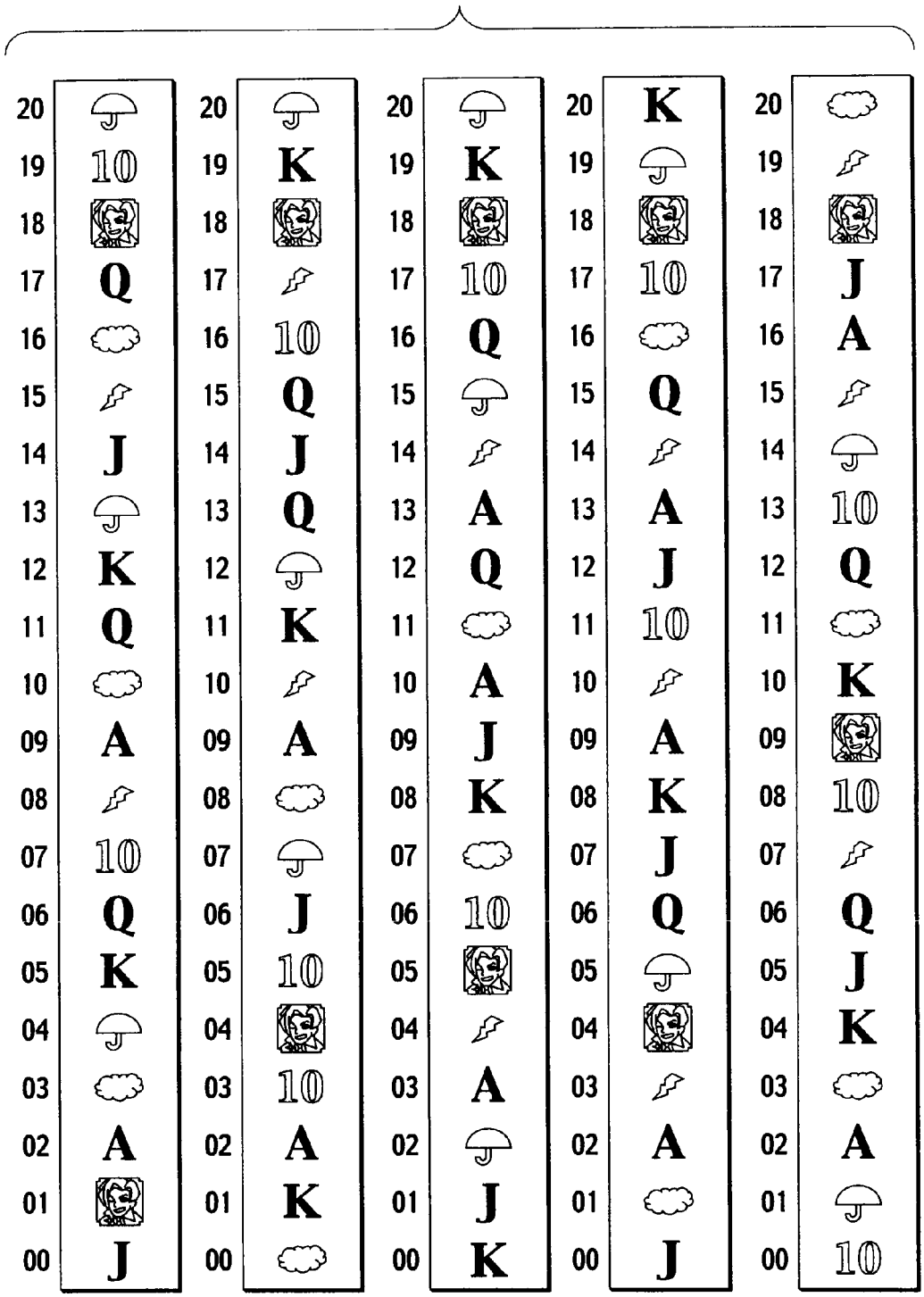
FIG. 15 is an explanatory view showing schematic configurations of symbols arranged on circumferential surfaces of rotating reels in the slot machine according to the fourth embodiment of the present invention.

Hereinafter, description will be given of a slot machine according to a fourth embodiment of the present invention, in which symbol rearrangement is performed by the rotating reel device disposed behind the liquid crystal panel of the display 16, and a control method thereof. FIG. 12 is a perspective view of the slot machine according to the fourth embodiment of the present invention. FIG. 13 is a block diagram showing a control circuit in the slot machine according to the fourth embodiment of the present invention. FIG. 14A is a perspective view and FIG. 14B is a side view showing the rotating reel device in the slot machine according to the fourth embodiment of the present invention. FIG. 15 is an explanatory view showing schematic configurations of symbols arranged on circumferential surfaces of rotating reels in the slot machine according to the fourth embodiment of the present invention.

As shown in FIG. 12, the slot machine 10 according to the fourth embodiment of the present invention is different in having the windows 16*a* to 16*e* and a rotating reel device 53 including rotating reels 53*a* to 53*e* disposed behind the windows 16*a* to 16*e* (see FIGS. 14A and 14B) instead of the display 16 in the slot machine 10 according to the first to third embodiments. The other constituent members are substantially the same as those of the slot machine 10 according to the first to third embodiments, and thus repetitive description will be omitted.

As shown in FIGS. 14A and 14B, the rotating reel device 53 has five rotating reels 53*a* to 53*e* corresponding to the windows 16*a* to 16*e* in the display 16, respectively. On a circumferential surface of each of the rotating reels 53*a* to 53*e*, as shown in FIG. 15, twenty-one symbols are laid out so as to be equally spaced apart. There are nine kinds of symbols, including "A (ace)", "K (king)", "Q (queen)", "J (jack)", "10", "umbrella", "lightning", "cloud" and "special (man's face)".

As shown in FIG. 13, the slot machine 10 of the fourth embodiment includes a motor drive circuit 51 and a reel position detecting circuit 52 in the machine controller 40 in the slot machine 10 in addition to the slot machine 10 of the first to third embodiments. Note that, along with provision of the rotating reel device 53, the slot machine 10 of the fourth embodiment further includes drive motors 56*a* to 56*e* in the rotating reel device 53, which are driven by the motor drive circuit 51, and sensors 54*a* to 54*e* for detecting, through the reel position detecting circuit 52, the rotation, the stop of the rotation, and also the position of the rotational stop of each of the rotatable reels 53*a* to 53*e* of the rotating reel device 53. As shown in FIG. 13, the motor drive circuit 51 and the reel position detecting circuit 52 are connected to the I/O bus 104 as in the case of the random number generating circuit 112, the communication interface circuit 111, the external storage device 113, the display controllers 140 and 141, the hopper drive circuit 124, the speaker drive circuit 122, the display drive circuit 128 and the like.

Note that the slot machine 10 of the fourth embodiment can perform display control of transparently displaying each of spots corresponding to the partitioned regions q11 to q54 in the windows 16*a* to 16*e* when the symbols are rearranged in the partitioned regions q11 to q54. Specifically, when the spots corresponding to the partitioned regions q11 to q54 in the windows 16*a* to 16*e* are arranged in the same order as that of symbol rearrangement, the CPU 106 generates an image display command signal for transparently displaying the corresponding spots, and then outputs the image display command signal to the display controller 140 through the I/O bus 104. Upon receipt of the image display command signal outputted by the CPU 106, the display controller 140 generates a drive signal for driving the display 16 on the basis of the image display command, and then outputs the generated drive signal to the display 16. Thus, the spots corresponding to the partitioned regions q11 to q54 in the order of symbol rearrangement are transparently displayed on the display 16.

Therefore, the CPU 106 outputs, at a timing corresponding to the progress of the slot game, the image display command for displaying the slot game image and the effect corresponding to the outcome thereof on the display 16 so that the display controller 140 receives the image display command. Thus, the effect corresponding to the slot game and the outcome thereof is displayed on the display 16.

The CPU 106 determines the symbols to be rearranged in the partitioned regions q11 to q54 by determining stop positions of the rotating reels 53*a* to 53*e*. Specifically, the CPU 106 determines the symbols to be rearranged in the partitioned regions q11 to q54 by selecting the stop positions of the rotating reels 53*a* to 53*e* based on random numbers generated by the random number generating circuit 112. To be more specific, the random number generating circuit 112 generates the same number of random numbers as that of the rotating reels 53*a* to 53*e*.

The thus configured slot machine 10 and control method thereof according to the fourth embodiment can also achieve the same effects as those achieved by the slot machine 10 and control method thereof according to the first to third embodiments.

Other Embodiments

Although the embodiments of the present invention have been described above, the embodiments are described merely as concrete examples and the present invention is not particularly limited thereto. The concrete configuration of each of the means and the like can be changed in design according to the necessity. Moreover, the effects described in the embodiments of the present invention are merely listed as preferred effects achieved by the present invention. The effects of the present invention are not limited to those described in the embodiments of the present invention.

For example, in the slot machine 10 according to the first to fourth embodiments, a probability of establishment of the predetermined condition in the normal unit game may be different from that in the free game. A probability of establishment of the retrigger is increased by increasing the probability of establishment of the predetermined condition in the free game. Thus, the expectations of the player can be increased by the processing of changing the game sound and incrementing the number of games, which is executed when the retrigger occurs.

Moreover, in the slot machine 10 according to the first to fourth embodiments, the description was given of the case where the predetermined condition is that three or more "special (man's face)" symbols are rearranged in the partitioned regions q11 to q54. However, the predetermined condition may be determined according to the number of the "special (man's face)" symbols rearranged on an active line provided in the partitioned regions q11 to q54.

Moreover, in the slot machine 10 according to the first to fourth embodiments, the description was given of the case where the predetermined condition is that three or more "special (man's face)" symbols are rearranged in the partitioned regions q11 to q54. However, the symbols are not limited to the "special (man's face)" symbols.

Moreover, in the first to fourth embodiments, the predetermined number of play times in the special game is set to 10. However, the predetermined number of special games is not limited to 10.

In addition, in the detailed description above, the characteristic portions are mainly described in order to make the present invention easily understandable. The present invention is not limited to the embodiments described in the detailed description above, and can be applied to the other embodiments, and its range of application is wide. Also, the terms and the terminology used in the present specification are used only for the purpose of explaining the present invention precisely, and not used for the purpose of limiting the interpretation of the present invention. Also, for those skilled in the art, it should be easy to contemplate other configurations, systems, methods, etc., that are contained in the concept of the present invention, from the content of the invention described in the present specification. Consequently, the description of the scope of claims should be construed as containing equivalent configurations within a range of not deviating from a range of the technical ideas of the present invention. Also, the purpose of the abstract is to make it possible for the patent office, the general public organizations, and technicians and the like who belong to the present technical field and who are not thoroughly familiar with patent and law terms or specialized terms, to quickly judge the technical content and its essence of the present application by a simple search. Consequently, the abstract is not intended to limit the scope of the invention which should be evaluated by the description of the scope of claims. Also, in order to sufficiently understand the purpose of the present invention and the effects specific to the present invention, they should preferably be interpreted by sufficiently referring to the documents and the like that are already disclosed in public.

Also, the detailed description above contains the processing to be executed by a computer. The explanations and expressions in the above are described for the purpose of facilitating the most efficient understanding by those skilled in the art. In the present specification, each step used in deriving one result should be understood as a processing without a self-contradiction. Also, at each step, transmission and reception, recording, etc., of electric or magnetic signals will be carried out. In the processing at each step, such signals are expressed by bits, values, symbols, letters, terms, numbers, etc., but it should be noted that they are used simply because they are convenient for the purpose of explanation. Also, there are cases where the processing at each step is described by an expression common to the human behavior, but the processing described in the present specification is to be executed by various devices in principle. Also, the other configuration required in carrying out each step will be obvious from the above description.

What is claimed is:

1. A slot machine comprising:

a bill identifier configured to identify whether an inserted bill is eligible and accept the inserted bill in a case that the inserted bill is eligible;

a display;

a speaker configured to emit a unit game sound, a first game sound, and a second game sound to an outside of the slot machine, wherein each of the unit game sound, the first game sound, and the second game sound is different;

a storage device configured to store unit game sound data, first sound data, and second sound data;

a speaker drive circuit configured to transmit the unit game sound data, the first sound data, and the second sound data to the speaker; and a controller configured to:

(a) receive a wager on a play of a unit game;

(b) begin the play of the unit game;

(c) read out the unit game sound data and transmit the unit game sound data to the speaker drive circuit to cause the speaker to emit the unit game sound;

(d) determine whether a rearrangement of symbols rearranged in the unit game satisfies a predetermined condition;

(e) when the predetermined condition is satisfied, read out the first sound data and transmit the first sound data to the speaker drive circuit to change the unit game sound to the first game sound, causing the first game sound to be emitted by the speaker while displaying at least a first one of a plurality of free games on the display;

(f) determine whether a rearrangement of symbols in the free games satisfies a predetermined retrigger condition; and (g) when the predetermined retrigger condition is satisfied, read out the second sound data and transmit the second sound data to the speaker drive circuit to change the first game sound to the second game sound, causing the second game sound to be emitted by the speaker while displaying a subsequent play of the free games on the display, and increase a current number of remaining free games.

2. The slot machine according to claim 1, wherein the controller is configured to change a song from the first game sound to the second game sound.

3. The slot machine according to claim 1, wherein the controller is configured to change a tempo from the first game sound to the second game sound.

4. A slot machine comprising:

a bill identifier configured to identify whether an inserted bill is eligible and accept the inserted bill in a case that the inserted bill is eligible;

a display configured to display a unit game rearranging a plurality of arranged symbols in partitioned regions, and to display a predetermined number of free games upon satisfaction of a predetermined condition;

a speaker configured to emit a unit game sound, a first game sound, and a second game sound to an outside sound of the slot machine, wherein each of the unit game sound, the first game sound, and the second game sound is different;

a storage device configured to store sound data for each of the unit game sound, the first game sound, and the second game sound;

a speaker drive circuit configured to transmit the sound data for each of the unit game sound, the first game sound, and the second game sound to the speaker; and a controller configured to (a) when the unit game is executed by a player placing a wager, read out the sound data for the unit game sound stored in the storage device and transmit the sound data for the unit game sound to the speaker drive circuit to cause the speaker to emit the unit game sound, and determine whether a rearrangement pattern of symbols rearranged in the unit game satisfies the predetermined condition;

(b) when the controller determines that the rearrangement pattern in the unit game satisfies the predetermined condition in the step (a), read out the sound data for the first game sound stored in the storage device and transmit the sound data for the first game sound to the speaker drive circuit to cause the speaker to emit the first game sound while displaying an execution of at least a first one of a plurality of free games on the display;

(c) determine whether a rearrangement pattern in the plurality of free games satisfies the predetermined condition again in each free game;

(d) when the controller determines that the rearrangement pattern satisfies the predetermined condition again in each free game in the step (c), notify the player that a retrigger has occurred by reading out the sound data for the second game sound stored in the storage device and transmit the sound data for the second game sound to the speaker drive circuit to cause the speaker to emit the second game sound while displaying an execution of at least a subsequent one of the plurality of free games on the display and (e) in a case that the controller determines that the rearrangement pattern satisfies the predetermined condition again in each free game, increase a current number of the plurality of free games remaining.

5. The slot machine according to claim 4, wherein the controller is configured to change songs from the first sound to the second game sound.

6. The slot machine according to claim 4, wherein the controller is configured to change a tempo from the first game sound to the second game sound.

7. A slot machine comprising:

a bill identifier configured to identify whether an inserted bill is eligible and accept the inserted bill in a case that the inserted bill is eligible;

a display;

a speaker configured to emit a first game sound and a second game sound to an outside of the slot machine;

a storage device configured to store first sound data and second sound data;

a speaker drive circuit configured to transmit the first sound data and the second sound data to the speaker; and a controller configured to:

(a) receive a wager on a play of a unit game;

(b) begin the play of the unit game;

(c) determine whether a rearrangement of symbols rearranged in the unit game satisfies a predetermined condition, (d) when the predetermined condition is satisfied, read out the first sound data and transmit the first sound data to the speaker drive circuit to change a current game sound in the unit game to the first game sound, causing the first game sound to be emitted by the speaker while displaying at least one of a plurality of free games on the display;

(e) determine whether a rearrangement of symbols in the free games satisfies a predetermined retrigger condition; and (f) when the predetermined retrigger condition is satisfied, read out the second sound data and transmit the second sound data to the speaker drive circuit to change the first game sound to the second game sound, causing the second game sound to be emitted by the speaker while displaying a subsequent play of the free games on the display; and (g) when the predetermined retrigger condition is satisfied, increase a current number of remaining free games.

8. The slot machine according to claim 7, wherein the controller is configured to change a song from the first game sound to the second game sound.

9. The slot machine according to claim 7, wherein the controller is configured to change a tempo from the first game sound to the second game sound.

10. A method for controlling a slot machine including a controller, a bill identifier configured to identify whether an inserted bill is eligible and accept the inserted bill in a case that the inserted bill is eligible, a display, a speaker, a storage device and a speaker drive circuit, the method comprising:

beginning, by the controller, a play of a unit game based on a wager by a player;

determining, by the controller, whether a rearrangement of symbols rearranged in the unit game satisfies a predetermined condition;

when the controller determines that the predetermined condition is satisfied, reading out a first sound data stored in the storage device and transmitting the first sound data to the speaker drive circuit to change a current game sound being emitted by the speaker in the unit game to a first game sound to be emitted by the speaker while displaying at least a first one of a plurality of free games on the display;

determining, by the controller, whether a rearrangement of symbols in the free games satisfies a predetermined retrigger condition; and when the predetermined retrigger condition is satisfied, reading out a second sound data stored in the storage device and transmitting the second sound data to the speaker drive circuit to change the first game sound being emitted by speaker in the free game to a second game sound to be emitted by the speaker for a subsequent play of the free games, the second game sound being difference than the first game sound, and increasing a current number of remaining free games by the controller.

11. The method for controlling the slot machine according to claim 10, wherein the first game sound comprises a different song than the second game sound.

12. The method for controlling the slot machine according to claim 10, wherein the first game sound comprises a different tempo than the second game sound.

13. A method for controlling a slot machine including a controller, a bill identifier configured to identify whether an inserted bill is eligible and accept the inserted a case that the inserted bill is eligible, a display configured to display a unit game rearranging a plurality of arranged symbols in partitioned regions and to display a predetermined number of free games upon satisfaction of a predetermined condition, a speaker, a storage device, and a speaker drive circuit the method comprising:

determining, by the controller based on a wager by a player, whether a rearrangement pattern of symbols rearranged in the unit game satisfies the predetermined condition;

when the controller determines that the rearrangement pattern in the unit game satisfies the predetermined condition, notify the player that a trigger has occurred by reading out a first sound data stored in the storage device and transmitting the first sound data to the speaker drive circuit to change a current game sound being emitted by the speaker in the unit game to a first game sound corresponding to the first sound data to be emitted by the speaker while displaying an execution of at least a first one of the plurality of free games on the display;

determining, by the controller, whether a rearrangement pattern in the free games satisfies the predetermined condition again in each free game;

when the controller determines that the rearrangement pattern satisfies the predetermined condition in each free game, notify the player that a retrigger has occurred by reading out a second sound data stored in the storage device and transmitting the second sound data to the speaker drive circuit to change the first game sound being currently emitted in the free game into a different second game sound corresponding to the second sound data to be emitted by the speaker while displaying an execution of at least a subsequent one of the plurality of free games; and when the controller determines that the rearrangement pattern satisfies the predetermined condition again in each free game, increasing a current number of the free games remaining.

14. The method for controlling the slot machine according to claim 13, wherein the first game sound comprises a different song than the different second game sound.

15. The method for controlling the slot machine according to claim 13, wherein the first game sound comprises a different temp than the different second game sound.

16. A method for controlling a slot machine, the method comprising:

determining, by a slot machine controller, whether a bill identifier accepted an inserted bill;

determining, by the slot machine controller, whether a wager was placed on a play of a unit game;

thereafter determining, by the slot machine controller, whether a rearrangement of symbols rearranged in the unit game satisfies a predetermined condition;

when the predetermined condition is satisfied, reading out, by the slot machine controller, a first sound data stored in a storage device in communication with the slot machine controller, and transmitting the first sound data to a speaker drive circuit to change a current game sound in the unit game to a first game sound while displaying at least a first one of a plurality of free games on a display device;

determining, by the slot machine controller, whether a rearrangement of symbols in the free games satisfies a predetermined retrigger condition;

when the predetermined retrigger condition is satisfied, reading out, by the slot machine controller, a second sound data stored in the storage device and transmitting the second sound data to the speaker drive circuit to change the first game sound to a second game sound while displaying at least a subsequent one of the plurality of free games, the second game sound being different than the first game sound; and when the controller determines that the predetermined retrigger condition is satisfied, increasing a current number of the plurality free games remaining.

17. The method for controlling the slot machine according to claim 16, wherein the first game sound comprises a different song than the second game sound.

18. The method for controlling the slot machine according to claim 16, wherein the first game sound comprises a different tempo than the second game sound.

* * * * *